US006797122B1

(12) United States Patent
Yoshida et al.

(10) Patent No.: US 6,797,122 B1
(45) Date of Patent: Sep. 28, 2004

(54) COKE OVEN AND METHOD OF OPERATING THE SAME

(75) Inventors: Shuhei Yoshida, Osaka (JP); Syoji Takase, Osaka (JP); Takafumi Saji, Kashima (JP); Makoto Uchida, Osaka (JP); Hiroyuki Koyama, Kitakyushu (JP)

(73) Assignee: The Japan Iron and Steel Federation, Tokyo (JP)

( * ) Notice: Subject to any disclaimer, the term of this patent is extended or adjusted under 35 U.S.C. 154(b) by 0 days.

(21) Appl. No.: 09/518,538

(22) Filed: Mar. 3, 2000

(30) Foreign Application Priority Data

Mar. 4, 1999 (JP) ..... 11-057726
Jun. 10, 1999 (JP) ..... 11-163549

(51) Int. Cl.[7] ..... C10B 51/00; C10B 21/20; C10B 1/06

(52) U.S. Cl. ..... 202/96; 202/124; 202/125; 202/126; 202/127; 202/138; 202/142; 202/242; 202/248; 202/267.1; 201/41

(58) Field of Search ..... 202/124, 125, 202/126, 127, 138, 142, 242, 248, 267; 201/41

(56) References Cited

U.S. PATENT DOCUMENTS 2,082,858 A 6/1937 Totzek
4,704,195 A 11/1987 Janicka et al.
5,017,270 A * 5/1991 Janicka et al. ..... 201/41
5,259,932 A 11/1993 Blase et al.

FOREIGN PATENT DOCUMENTS

| | | |
|---|---|---|
| JP | 61-133286 | 6/1986 |
| JP | 1-306494 | 12/1989 |
| JP | 2-501073 | 4/1990 |
| JP | 4-501876 | 4/1992 |

OTHER PUBLICATIONS

European Search Report for Application No. 00400569.0–1213 dated May 15, 2002.

* cited by examiner

*Primary Examiner*—Glenn Caldarola
*Assistant Examiner*—Alexis Wachtel
(74) *Attorney, Agent, or Firm*—Burns, Doane, Swecker & Mathis, L.L.P.

(57) ABSTRACT

A coke oven and a method of operating the same, capable not only of achieving a uniform combustion temperature heightwise within a combustion chamber when a rich gas or a lean gas is burnt, but also of reducing $NO_x$ content in the waste gas, while eliminating localized high-temperature combustion. The combustion chamber of the coke oven comprises a rich-gas port 2 located near an oven wall 6 bordering a carbonization chamber in the bottom 5 of combustion chamber, and the midpoint P3, connecting the center P2 of a lean-gas port 7 and the center P of an air port 3, is on the side opposite to the rich-gas port 2 relative to the center line CL of the combustion chamber. (See FIG. 2)

22 Claims, 17 Drawing Sheets

(a)

(b)

(a)

(b)

(a)

(b)

COKE OVEN AND METHOD OF OPERATING THE SAME

FIELD OF THE INVENTION

The present invention relates to a coke oven having improved combustion chambers and a method of operating the same. The coke oven of the present invention allows uniform combustion to be achieved in the direction of the height of the combustion chambers, thereby reducing the $No_x$ (nitrogen oxides) in the waste gas generated as a result of combustion.

BACKGROUND OF THE INVENTION

The basic performance required of a coke oven is to produce high-quality coke, to reduce fuel consumption, and to achieve these objects at a low cost. In addition to such basic performance, what has been called for in recent years is less $No_x$ contents in the waste gas.

Requirements for preventing environmental pollution have become increasingly severe year by year. The regulated $NO_x$ emission standards, specified by law for newly installed coke ovens, are quite stringent compared with those for existing coke ovens, and thus it is likely that new coke ovens cannot be constructed based on the prior art.

The $NO_x$ content in the waste gas increases with increasing combustion temperature. Therefore, $No_x$ in the waste gas of a coke oven can be reduced by decreasing the combustion temperature in the combustion chambers. However, the combustion temperature must be higher than a predetermined value for the purpose of producing coke, and inevitably increases with higher operation rates. Therefore, the most realistic $NO_x$ reduction measure would be to eliminate localized, abnormal high temperature by achieving uniform combustion in the direction of oven height of the combustion chambers. However, since each combustion chamber of a coke oven has a slender, grooved structure (i.e., it is remarkably high in the vertical direction with respect to its horizontal cross-sectional area), it is difficult to achieve uniform combustion due to it's a structure. The difficulty increases particularly with tall coke ovens.

The combustion temperature can be reduced locally by increasing flame lengths, e.g., by decreasing the calorific value of a fuel gas while diluting the fuel gas with the waste gas. The following methods are available as the specific measures:

(1) A method in which the waste gas in the combustion chamber is circulated, thereby increasing flame lengths and hence decreasing flame temperatures. This method is accomplished in Koppers circulation type coke ovens;

(2) A method in which combustion is scattered by partially supplying both the combustion air and a lean gas or only combustion air from a plurality of heightwise arranged ports partially (see Japanese Unexamined Patent Application Laid-Open Nos. 61-133286(1986) and 1-306494 (1989), and Published Japanese Translation of PCT International Publication No. 4-501876(1992). This method is adopted in Carl Still coke ovens, Otto coke ovens, and Nippon Steel Corporation coke ovens as a multistage supply system for only combustion air, particularly when a rich gas in used as fuel. This method is called "the multistage combustion method."

Here, fuel gases used for coke ovens include not only a high calorific gas, such as a coke-oven gas called a rich gas, but also a gas called a lean gas. The rich gas means a fuel gas whose calorific value ranges from 14700 to 20160 kJ/Nm$^3$ (3500 to 4800 kcal/Nm$^3$), and the lean gas means a blast-furnace gas or a mixed gas of a blast-furnace gas and a coke-oven gas whose calorific values range from 3360 to 5460 kJ/Nm$^3$ (800–1300 kcal/Nm$^3$).

Therefore, (a) rich gas combustion and (b) lean gas combustion take place in a coke oven. An oven that can handle either (a) or (b) is called a single combustion coke oven, and an oven that can handle both (a) and (b) is called a compound combustion coke oven.

The method in (1), described previously, is aimed at accomplishing the slowing down of the combustion progress in the direction of oven height by reducing the oxygen content and the calorific value of the fuel gas while circulating the waste gas, and thus is effective for controlling the amount of $NO_x$ generated. However, in this method the amount of waste gas increases, and energy losses also increase when the amount of circulated waste gas is increased. Further, in the waste gas circulation method based on the Koppers coke oven circulation system, it is difficult to increase the waste gas circulation rate greatly due to the restricted cross-sectional area of a circulation port. The rate can be increased to about 20% at most. In addition, the amount of waste gas circulated cannot be varied as desired, either.

The method of reducing $NO_x$ by multistage combustion in (2), described previously, requires adjustment of the distribution ratio of the combustion air or lean gas, in the direction of oven height during the operation of the coke oven when the amount of fuel gas is greatly varied. However, in the actual coke oven operation, not only such an adjustment entails much time, but also the place to be adjusted is limited mainly to the ports at the uppermost stage and at the bottom, imposing difficulty adjusting the apertures of intermediate ports, and thus a satisfactory effect on $NO_x$ reduction cannot be obtained.

An exemplary bottom structure of the combustion chamber of a coke oven is disclosed in the previously described Published Japanese Translation of PCT International Publication No. 4-501876(1992) and Cokemaking International, Vol. 4-2, pp.71–83 (1992). As shown in FIG. 9(*a*), a rich-gas port 2 is arranged near an oven wall 6 of a coke oven, and a lean-gas port 7 and an air port 3 are arranged side by side in the middle. Further, Japanese Publication of Examined Patent Application No. 5-29678 (1993) discloses a drawing in which a lean-gas port and an air port extend in the direction of coke pushing (i.e., direction of oven length), side by side, almost in the middle of a combustion chamber. However, no description is made as to the arrangement and structure of the lean-gas port and the air port, for achieving a uniform combustion temperature in the direction of oven height and for reducing $NO_x$ in the waste gas.

SUMMARY OF THE INVENTION

The basic object of the present invention is to provide a coke oven and a method of operating the same that forms a waste gas containing less $NO_x$.

A specific object of the present invention is to provide a coke oven, having a combustion chamber that can eliminate localized high-temperature combustion by achieving uniform combustion in the direction of oven height, even if the oven is of a tall, large-sized structure.

Another specific object is to provide a coke oven having a combustion chamber that can achieve the above-described uniform combustion independently of the combustion type, i.e., either single combustion in which either a rich gas or lean gas is used as fuel, or compound combustion in which both are used alternately.

Still another specific object is to provide a method of in operating a coke oven that allows $NO_x$ in the waste gas to be reduced by achieving uniform combustion within the combustion chamber.

The present invention pertains to a coke oven such as shown in FIG. 1. In FIG. 1, reference numerals I, II, III . . . denote arrays of combustion chambers, and i, ii, . . . , denote carbonization chambers. The combustion chamber arrays and the carbonization chambers are arranged alternately in the direction of oven battery (Y direction). Each combustion chamber array consists of many combustion chambers 1-1, 1-2, 1-3, 1-4 . . . that extend in the direction of coke pushing (X direction). What is to be improved by the present invention are the structure of these combustion chambers and the combustion method applied to such combustion chambers.

Here, the direction of oven battery means the direct ion in which many combustion chambers (specifically, a plurality of combustion chambers divided by flue partition walls, or so-called an array of flues) and carbonization chambers extend alternately in parallel. Further, the direction of coke pushing means the direction at right angles to the direction of oven battery, and in the direction of connecting the pusher side to the coke discharging side in a coke oven.

A method of combustion within the combustion chamber includes the singlestage combustion system, in which all of a rich gas or lean gas as a fuel gas is supplied from the bottom of combustion chamber and all of combustion air (hereinafter described simply as "air") is supplied from the bottom of combustion chamber, and the multistage combustion system, in which part of air and/or a lean gas is supplied from the bottom and the rest thereof from one or a plurality of places in the direction of oven height. Furthermore, types of ovens include a single combustion oven for supplying only a rich gas or lean gas as a fuel gas, and a compound combustion oven that can supply a rich gas and a lean gas alternately. The present invention is directed to a coke oven having a structure capable of accommodating all these types of combustion systems.

A coke oven of the present invention comprises a combustion chamber having characteristic features (1) and (2) described below;

(1) As shown in FIG. 3, the rich-gas port 2 is located at the bottom 5 of combustion chamber near the oven wall 6 bordering the carbonization chamber;

(2) The midpoint P1 connecting the centers P of the air ports 3 at the bottom 5 is on the side opposite to the rich-gas port 2 across the center line CL extending in the direction of coke pushing of the combustion chamber in parallel to the oven wall 6.

It is further required that the following characteristic feature (3) and (4) be obtained for compound combustion.

(3) As shown in FIG. 6(*a*), when viewed in the direction of coke pushing (X direction) and in the direction of oven battery (Y direction) of the combustion chamber, the lean-gas port 7 and the air port 3, that have their openings in the bottom of the combustion chamber, do not completely overlap in any of these directions.

(4) As shown in FIG. 4, the midpoint P3 connecting the center P2 of the lean-gas port 7 and the center P of the air port 3 at the bottom is on the side opposite to the rich-gas port 2 across the center line CL.

Combustion chamber zones 5-1 and 5-2 defined by center line CL as shown in FIG. 3(*b*) are referred to the first zone and the second zone respectively hereinafter.

The lean-gas port 7 and the air port 3, described above, may partially overlap when viewed in the direction of coke pushing (X direction) or in the direction of oven battery (Y direction), as shown in FIGS. 7(*b*) and (*c*). At this time, it is desirable that the length of the overlapped openings is 80% or less of a complete overlapped length (L shown in FIG. 8). Further, an aperture adjusting member 9 may be attached to at least one of the lean-gas port 7 and the air port 3, as shown in FIG. 5, to thereby narrow the original overlap rate from $Y_2$ to $Y_{21}$, so the above-described overlap rate of 80% or less can be achieved. Here, the opening of a port means an opening originally provided when the oven was installed, or an opening narrowed by attaching the aperture adjusting member.

Methods of the present invention are operating methods of the above-described coke oven of the present invention, and the typical methods are as follows:

(1) A method of effecting singlestage combustion by supplying the total amount of a lean gas and that of air from ports at the bottom of combustion chamber, respectively;

(2) A method of effecting multistage combustion by supplying all of the lean gas from the port at the bottom of combustion chamber and part of the air (20 to 70% by volume) from the port at the bottom of combustion chamber, and supplying the rest of the air from one or more ports provided in a flue partition wall;

(3) A method of effecting multistage combustion by supplying part of the lean gas from the port at the bottom of combustion chamber and the rest thereof from the ports provided in the flue partition wall, and supplying all of the air from the port at the bottom of combustion chamber;

(4) A method of effecting multistage combustion by supplying part of the lean gas from the port at the bottom of combustion chamber and the rest thereof from the port(s) provided in the flue partition wall, and supplying part of the air (20–70% by volume) from the port at the bottom of combustion chamber and the rest thereof form the port(s) provided in the flue partition wall;

(5) A method of effecting singlestage combustion by supplying the total amount of a rich gas and that of the air from the ports at the bottom of combustion chamber;

(6) A method of effecting multistage combustion by supplying all of the rich gas from the port at the bottom of combustion chamber, and supplying part of the air (50% by volume or more) from the port at the bottom of combustion chamber and the rest thereof from the port(s) provided in the flue partition wall.

In any of the above-described methods, the air purging direction is changed by mounting the aperture adjusting member 9 on the opening of the lean-gas port 7 and/or the air port 3 that extends toward the rich-gas port 2, by crossing the center line CL extending in the direction of coke pushing of the bottom of combustion chamber, so that the mixing point of the rich gas and air can be adjusted. This adjustment has the function of changing the air purging direction oppositely to the rich-gas port. Further, in the case of lean gas combustion, it is desirable that not only the aperture adjusting members be mounted on the openings of the ports, to thereby obtain an overlap rate of 80% or less, but also the lean gas purging direction and the air purging direction be changed to adjust the mixing point of the lean gas and air. Here, "the mixing point of the rich gas or lean gas and air" means the position in the direction of oven height from the bottom of combustion chamber at which the fluxes of the purged fuel gas and air initially collide with each other.

DETAILED DESCRIPTION OF THE INVENTION

1. Coke Oven of the Present Invention

As described earlier, the combustion chamber of a coke oven has a structure that is elongated in the direction of its height, and thus it is difficult to achieve uniform combustion therewithin. Although the multistage combustion method or the waste gas circulation method is used in order to achieve uniform combustion, as described previously, their effect is not yet satisfactory. In order to investigate combustion conditions within such a combustion chamber, the inventors carried out combustion tests, using a model combustion oven, and found out the following facts.

(a) The fuel gas and air supplied from the bottom of combustion chamber are diffused and mixed, and rise within the combustion chamber while burning. In the combustion within such a combustion chamber of a coke oven, i.e., within a narrow and limited space, combustion is promoted in a limited region, in the heightwise direction, in which the fuel gas is mixed well with air (particularly, in the lower region of the combustion chamber) although the highest combustion temperature differs depending on the amount of the fuel gas supplied and its calorific value, air ratio and the like. Further, not only a high temperature zone is formed in that region to thereby increase the $NO_x$ generation rate, but also a low temperature zone is, on the other hand, formed in another region (the upper region of the combustion chamber) to impair the uniformity of the temperature within the chamber.

(b) In order to suppress the formation of the above-described localized high-temperature zone within the combustion chamber, it is important to decrease the ratio of mixing fuel and air in the lower region of the combustion chamber, or in other words, to partially mix the fuel gas with air.

(c) Specific means for achieving the above-described partial mixture is to optimize the arrangement of ports for supplying the fuel gas and air from the bottom of combustion chamber, whereby the localized high-temperature zone is no longer formed and thus $NO_x$ in the waste gas can be minimized.

(d) In the case of a compound combustion oven, in which a rich gas is used as fuel and air (instead of a lean gas) is supplied from a lean-gas port, it is necessary to optimize the arrangement of the rich-gas port, the lean-gas port and the air port at the bottom of combustion chamber.

(e) In the case where a lean gas is used instead of a rich gas as fuel, it is necessary to optimize the arrangement of the lean-gas port and the air port.

The present invention has been made on the basis of the above-described viewpoints. The following describes the embodiments and operation of a coke oven of the present invention.

Figure 1:
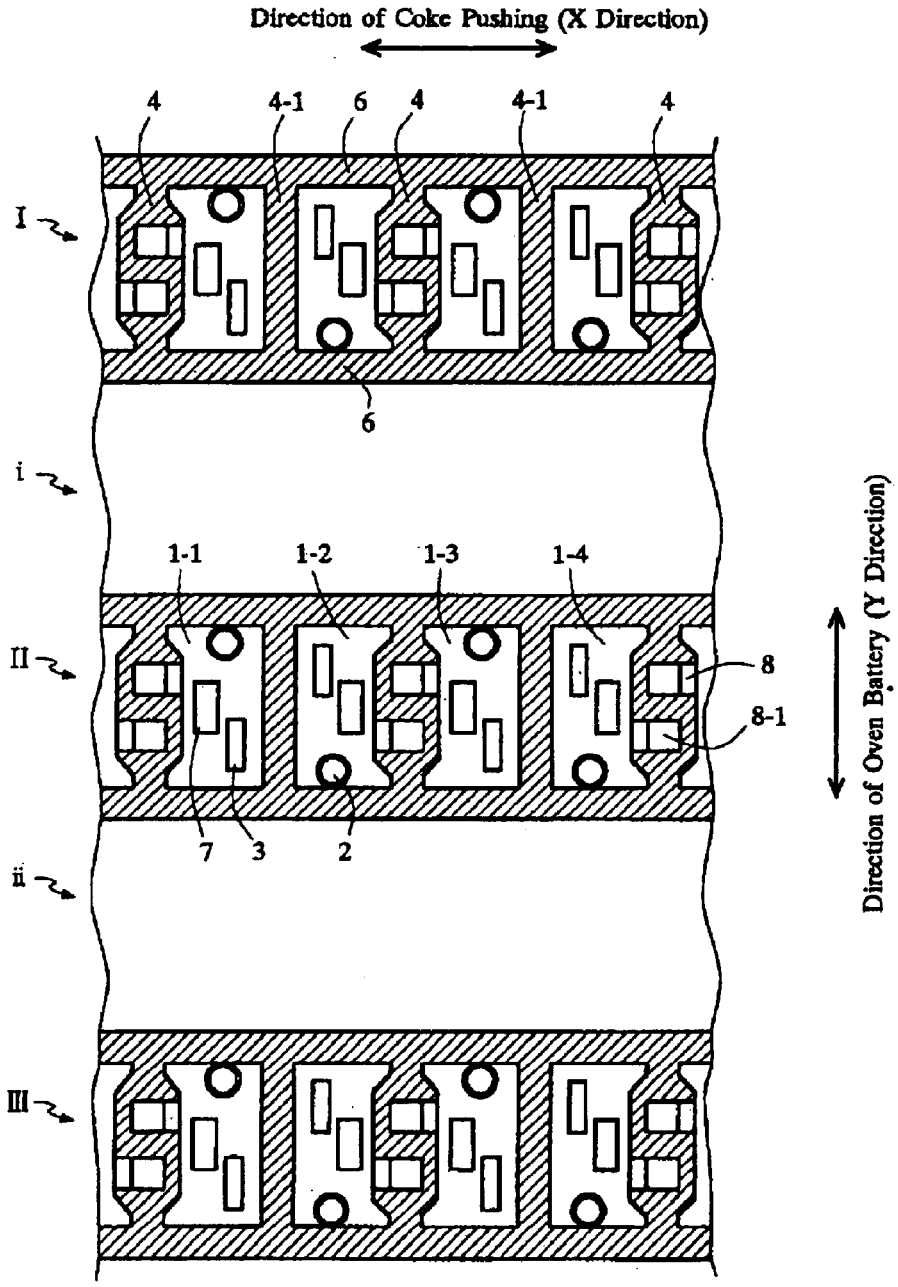
FIG. 1 is a horizontal sectional view of an oven for illustrating the general construction of a coke oven according to the present invention.

As previously described, the gist of the present invention is an improved structure of the combustion chambers (1-1, 1-2, 1-3, 1-4 . . . ) of the coke oven shown in FIG. 1. In FIG. 1, reference numeral 2 denotes a rich-gas port; 3, an air port; and 7, a lean-gas port. Reference numerals 8 and 8-1 denote an air port and an air duct respectively that are provided in a flue partition wall 4.

Figure 2:
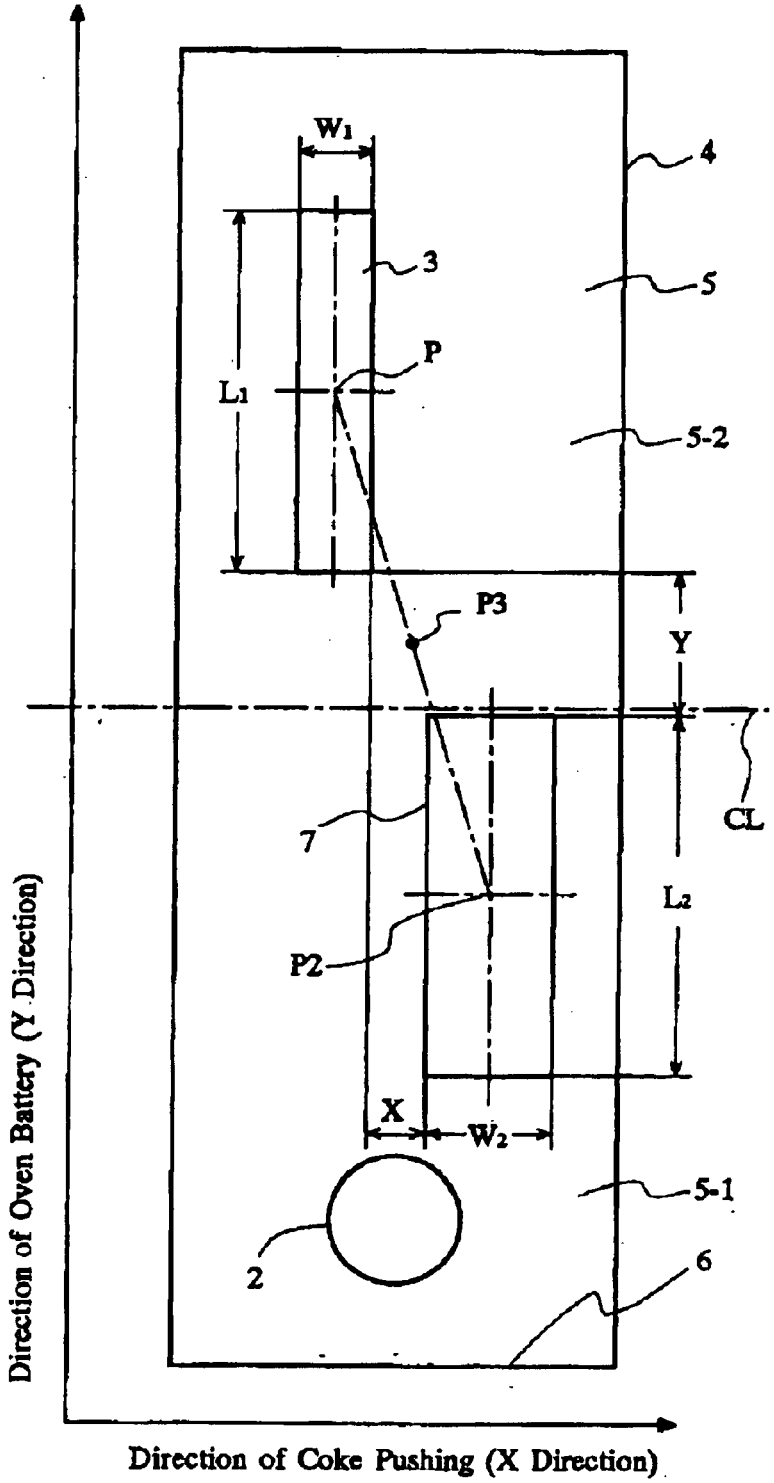
FIG. 2 is a diagram schematically showing the arrangement of a rich-gas port, a lean-gas port and an air port at the bottom of a combustion chamber for illustrating the principle of the present invention.

FIG. 2 is a diagram showing an exemplary arrangement of the rich-gas port, the lean-gas port and the air port at the bottom of combustion chamber. As shown in FIG. 2, the rich-gas port 2 in located near an oven wall 6 of the first zone 5-1. In other words the zone wherein the rich-gas port 2 exists_is called "the first zone". The midpoint P3 between the center P of the air port 3 and the center P2 of the lean-gas port 7 is in the second zone 5-2, i.e., in the side opposite to the rich-gas port across the center line CL.

FIG. 2 shows an example in which when the air port 3 and the lean-gas port 7 are viewed both in the direction of coke pushing (X direction) and in the direction of oven battery (Y direction), they do not overlap at all in any of these directions.

Figure 3:
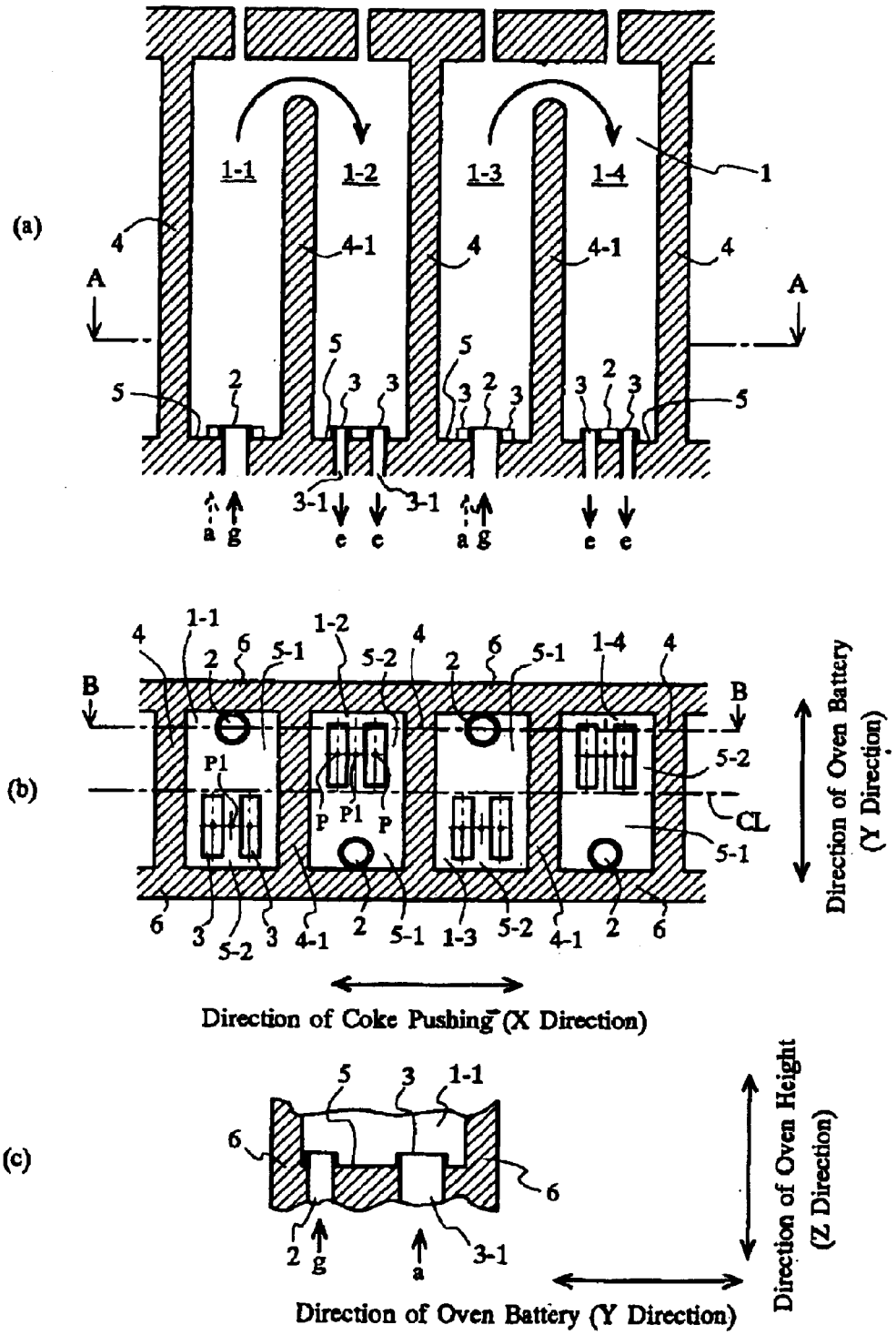
FIG. 3 is a conceptual diagram showing an example of a combustion chamber of single combustion and singlestage combustion type.

FIG. 3 is a conceptual diagram_showing an example of a combustion chamber of the single combustion and singlestage combustion type. FIG. 3(*a*) is a vertical sectional view of part of combustion chambers, arranged side by side, in the direction of coke pushing as viewed in the direction of oven battery, and is a sectional view taken along a line B—B of FIG. 3(*b*). FIG. 3(*b*) is a plan view showing part of the combustion chambers, arranged side by side, in the direction of coke pushing, showing the arrangement of the rich-gas port and the air ports at the bottom of combustion chamber, and is a sectional view taken along a line A—A of FIG. 3(*a*). FIG. 3(*c*) is a vertical sectional view of part of the bottom of combustion chamber as viewed in the direction of coke pushing, wherein "Z direction" means the direction of the oven height.

Figure 4:
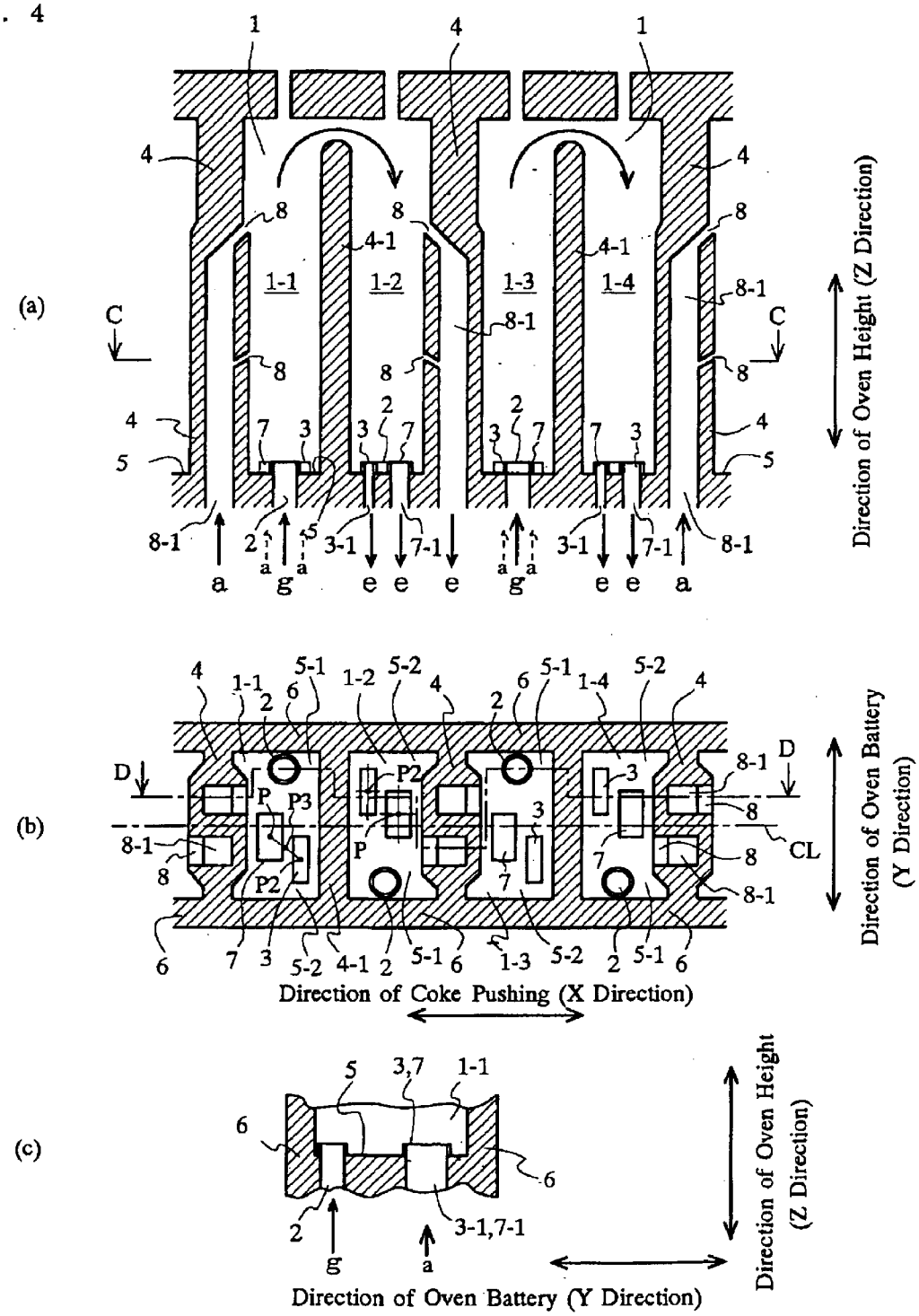
FIG. 4 is a conceptual diagram showing an example of a combustion chamber of a compound combustion and multistage combustion coke oven.

FIG. 4(*a*) is a vertical sectional view of part of combustion chambers, arranged side by side, in the direction of coke pushing as viewed in the direction of oven battery, and is a vertical sectional view taken along a line D—D of FIG. 4(*b*). FIG. 4(*b*) is a plan view showing part of the combustion chambers, arranged side by side, in the direction of coke pushing, and is a horizontal sectional view taken along a line C—C of FIG. 4(*a*). The array of combustion chambers shown in FIG. 4(*b*) is interposed between of carbonization chambers (not shown) through the oven walls 6. FIG. 4(*c*) is a vertical sectional view of part of the bottom of combustion chamber as viewed in the direction of coke pushing.

In FIG. 4, the combustion chambers 1-1 to 1-4 are separated from their adjacent combustion chambers by flue partition walls 4 and 4-1. Two secondary air ports 8 are provided heightwise in each flue partition wall 4 and are supplied with air from the secondary air duct 8-1. In the bottom 5 are a lean-gas duct 7-1, a primary air duct 3-1 and the rich-gas port 2. The lean-gas duct 7-1 and the primary air duct 3-1 are connected to the lean-gas port 7 and the primary air port 3, respectively.

Each of FIGS. 3 and 4 shows a case where the combustion chambers 1-1 and 1-2 are used as a set. That is, when combustion is occurring in one (e.g., 1-1) of the combustion chambers, the other chamber (1-2) serves as a waste gas discharging passage. When the direction of combustion is reversed, so are their functions. The same applies to a set consisting of the combustion chambers 1-3 and 1-4. The set of combustion chambers 1-1 and 1-2 serves as a representative example in the following description.

In single combustion and singlestage combustion with a rich gas, the rich gas (g) is supplied to the combustion chamber 1-1 from the rich-gas port 2 provided in its bottom 5 as shown in FIG. 3(*a*), mixed with air (a) supplied from the air ports 3 to burn and rise, thereby heating the oven walls 6. A waste gas (e) in discharged into a regenerator (not shown) from the air ports 3 while getting over the flue partition wall 4-1 as shown by the arrow and then going down within the combustion chamber 1-2. In FIG. 3(*a*), each arrow shows the direction in which the gas flows, and the air (a) is supplied to the combustion chamber from the air ports 3 through the ducts 3-1, provided in the bottom of combustion chamber 5. While two air ports 3 are provided in the bottom of combustion chamber 5 in FIG. 3(*a*), the number of the ports may be one as well.

In the bottom of combustion chamber, the rich-gas port 2 is located at the position near the oven wall 6 of the first zone 5-1 bordering the carbonization chambers (i , ii in FIG. 1), as shown in FIG. 3(*b*). The midpoint P1, connecting the centers (P) and (P) of the two air ports 3, is located in the second zone 5-2 of the combustion chamber. With this arrangement, the mixing point of the purged rich gas (g) and air (a) moves upward. In other words, the fuel and air are partly mixed and burnt in the lower region of the combustion chamber, and the majority of the fuel and air are burnt while mixed gradually heightwise. Therefore, a uniform combustion temperature can be achieved heightwise, and thus abnormal high-temperature combustion and $NO_x$ generation can be reduced. Here, "the position near the oven wall" means any position specified by a distance equal to or smaller than 40% of the inside length (distance between oven walls 6) of the bottom of combustion chamber, as viewed in the direction of oven battery from the inner side of the oven wall 6 that borders the carbonization chamber, as viewed in the direction of oven battery.

In compound combustion and multistage combustion, as shown in FIG. 4, the rich gas (g) is supplied to the combustion chamber 1-1 from the rich-gas port 2, mixed with the air (a) supplied from the lean-gas port 7 and the air port 3, thereby burning and rising to heat the oven walls 6. The waste gas (e) goes down within the combustion chamber 1-2 while getting over the flue partition wall 4-1, as shown by the arrow, and discharged into a regenerator (not shown) from the air ports 8 provided in the flue partition wall 4 and from the air port 3 and the lean-gas port 7, provided in the bottom of combustion chamber 5. The duct 8-1 is provided inside the flue partition wall 4 of the combustion chamber for connecting the air ports 8 to the regenerator. Further, the duct 3-1 is provided in the bottom of combustion chamber 5, connecting the air port 3 to the regenerator. FIG. 4 shows an example in which the air port 3 and the lean-gas port 7 are staggered in the direction of oven battery.

The air (a) is supplied to the combustion chamber 1 from the air port 3 and the lean-gas port 7 provided in the bottom of combustion chamber 5 and from the air ports 8 provided in the flue partition wall 4. The gas flows in the same manner as in FIG. 3.

At the bottom of combustion chamber shown in FIG. 4, the rich-gas port 2 is located at the position near the oven wall 6 of the first zone 5-1_as shown in FIG. 4(*b*), and the midpoint P3 connecting the center P2 of the lean-gas port 7 and the center (P) of the air port 3 is in the second zone 5-2, i.e., on the side opposite to the rich-gas port 2, relative to the center, line CL extending in the direction of coke pushing of the combustion chamber. When the air (a) is supplied from the air port 3 and the lean-gas port 7, the air purging center position is opposite to the rich gas purging center position, and thus the mixing point of the rich gas and air moves upward. As a result, part of the air mixes with the rich gas in the lower region of the combustion chamber, whereas the majority of the air gradually mixes with the rich gas so that burning occurs gradually in the direction of oven height, thereby achieving a uniform combustion temperature in the direction of oven height and hence reducing $NO_x$ generation.

Figure 5:
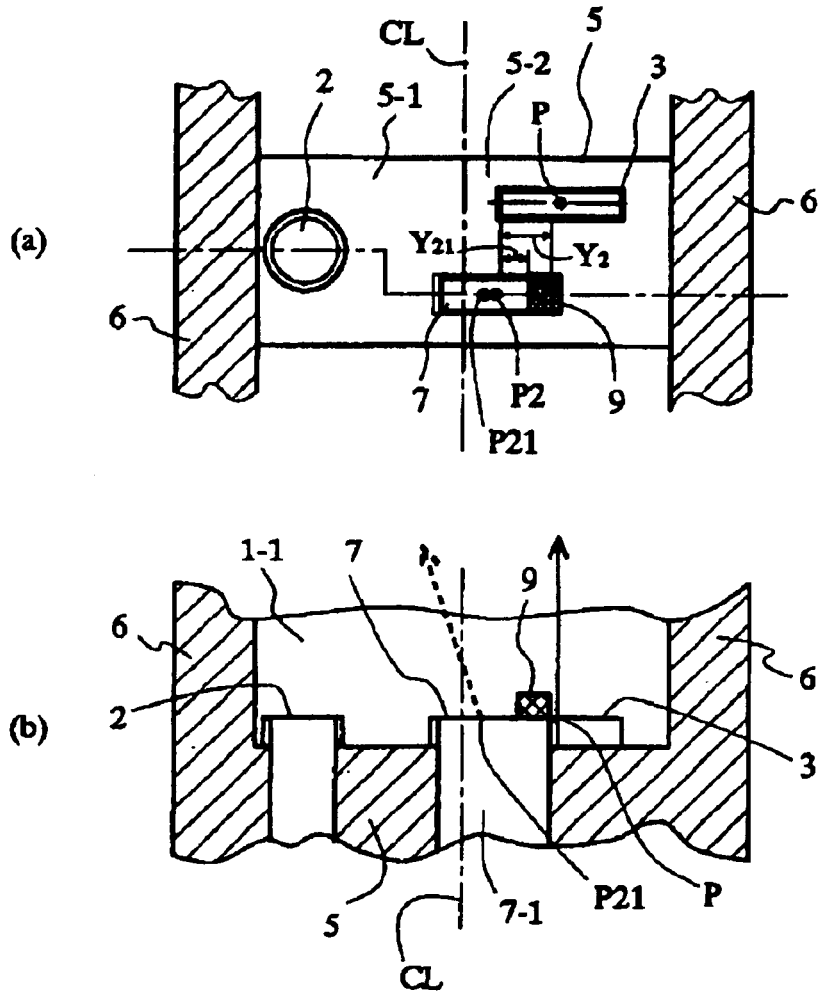
FIG. 5 is a diagram showing an example in which the aperture of a lean-gas port is adjusted.

As shown in FIG. 4(*b*), in the case where the ports are staggered, when part of both or one of the air port 3 and the lean-gas port 7 are located nearer the rich-gas port by crossing the center line CL, extending in the direction of coke pushing, it is desirable that an aperture adjusting member 9 be mounted on part of the port as shown, e.g., in FIG. 5 to thereby change the air purging direction so as to be opposite to the rich gas purging direction and hence move the mixing point of the rich gas and air upward.

FIG. 5 is a diagram showing an example in which the opening of the air port, part of which is on the side of the rich-gas port by crossing the center line extending in the direction of coke pushing of the combustion chamber, is closed with the aperture adjusting member. FIG. 5(*a*) is a partially sectional plan view thereof and FIG. 5(*b*) a vertical sectional view thereof. In FIG. 5(*a*), the air port 3 and the lean-gas port 7 are staggered, and their centers P and P2 and the midpoint P3 connecting these centers P and P2 are on the side opposite to the rich-gas port 2 relative to the center line CL extending in the direction of coke pushing battery of the bottom of combustion chamber. However, part of the opening of either of the ports 3 and 7 is located nearer the rich-gas port by crossing the center line extending in the direction of coke pushing of the bottom of combustion chamber. In such a case, the aperture adjusting member 9 is mounted on part of the opening so that the apertures of the ports are adjusted. With this arrangement, the air is purged in the direction opposite to the rich-gas port as shown by the arrow of FIG. 5(*b*), thereby moving upward the mixing point of the rich gas and air in the lower region of the combustion chamber. As a result, a uniform combustion temperature can be achieved in the direction of oven height to thereby reduce $NO_x$ generation.

When the rich gas combustion is performed in the multistage combustion chamber, if the amount of air to be supplied from the bottom of combustion chamber is 50% by volume or less of the total amount, combustion in the lower region of the combustion chamber is insufficient and thus the temperature drops tend to occur in the lower region of the carbonization chamber. Therefore, it is desirable that the amount of air to be supplied from the bottom of the combustion chamber be 50% by volume or more of the total amount.

Next, lean gas combustion will be described.

Figure 6:
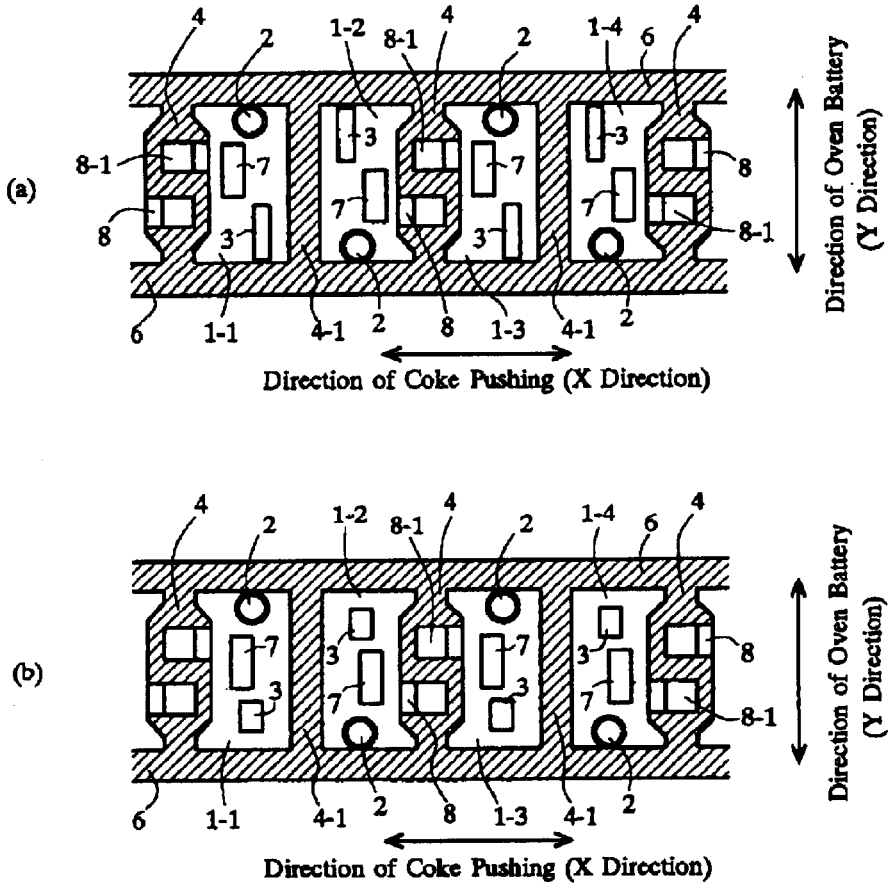
FIG. 6 is a plan view showing the arrangement of a lean-gas port and an air port at the bottom of combustion chamber.

In order to reduce $NO_x$ in the lean gas combustion, it is desirable that the positional relationship between the lean-gas port and the air port be as shown in FIG. 6. FIGS. 6(*a*) and (*b*) are plan views similar to FIG. 4(*b*) and show examples of different arrangements of the lean-gas port 7 and the air port 3.

Figure 7:
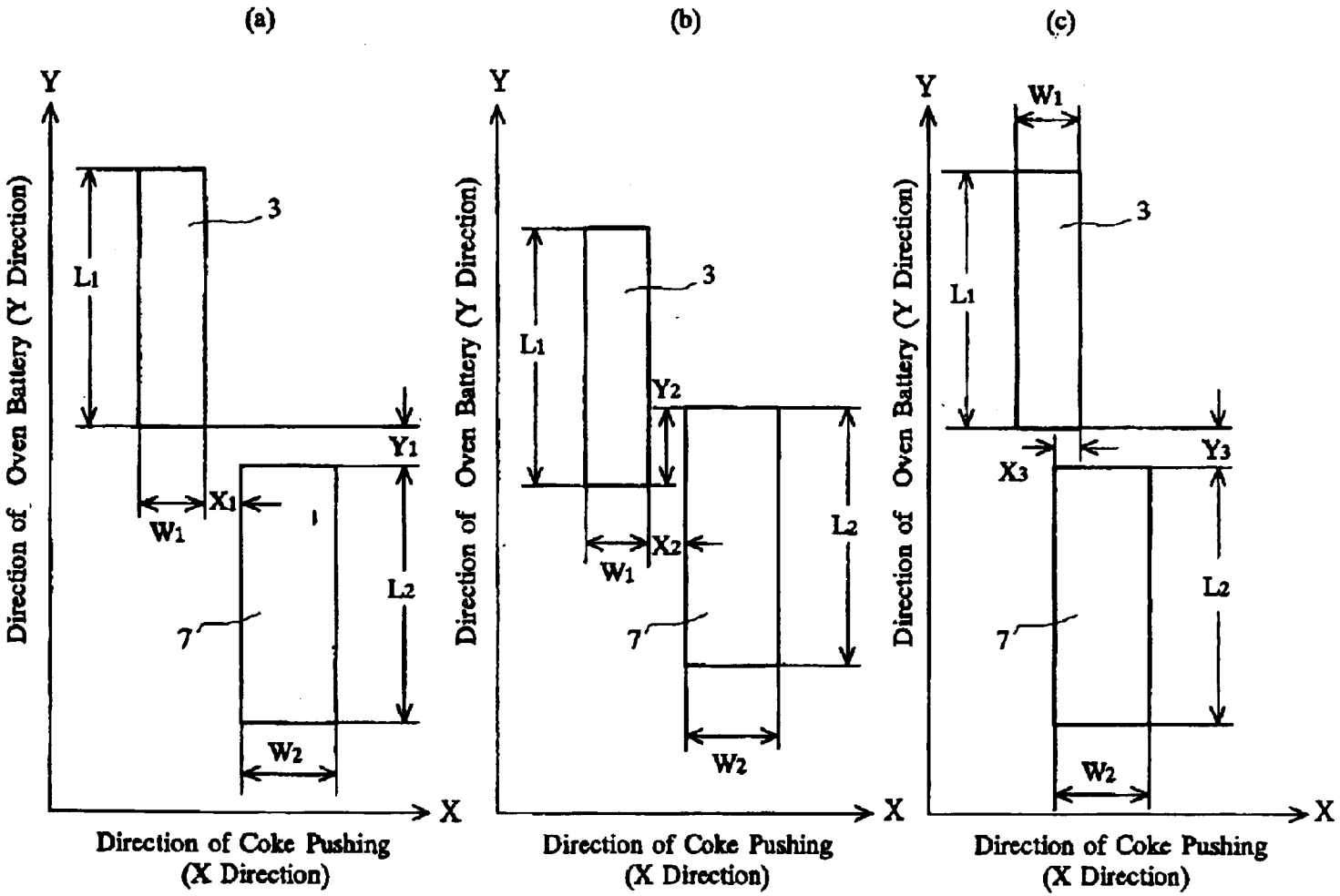
FIG. 7 is a diagram schematically showing the arrangement of a lean-gas port and an air port for illustrating the principle of the present invention.

FIG. 7 is a diagram schematically showing how the lean-gas port 7 and the air port 3 are arranged in one of the combustion chambers shown in FIG. 6. Note that the structure of one of any two adjacent combustion chambers (e.g., 1-1 and 1-2 of FIG. 6) is an inversion of the structure of the other, and thus the structure of one of them, i.e., the combustion chamber 1-2, will hereinafter represent the structure of these combustion chambers.

FIG. 7(*a*) shows an example in which the lean-gas port 7 and the air port 3 do not overlap when viewed both in the direction of oven battery (Y direction) and in the direction of coke pushing (X direction). That is, the ports 3 and 7 are separated by an interval X, in the direction of coke pushing and by an interval $Y_1$ in the direction of oven battery.

In FIG. 7(*b*), the lean-gas port_7 and the air port 3 are separated by an interval $X_2$ when viewed in the direction of oven battery (Y direction), but they overlap by a length $Y_2$ when viewed in the direction of coke pushing (X direction).

FIG. 7(*c*) shows the arrangement shown in FIG. 6(*b*). That is, the lean-gas port 7 and the air port 3 overlap by a length $X_3$ when viewed in the direction of oven battery (Y direction), but they are separated by an interval Y, when viewed in the direction of coke pushing.

Figure 8:
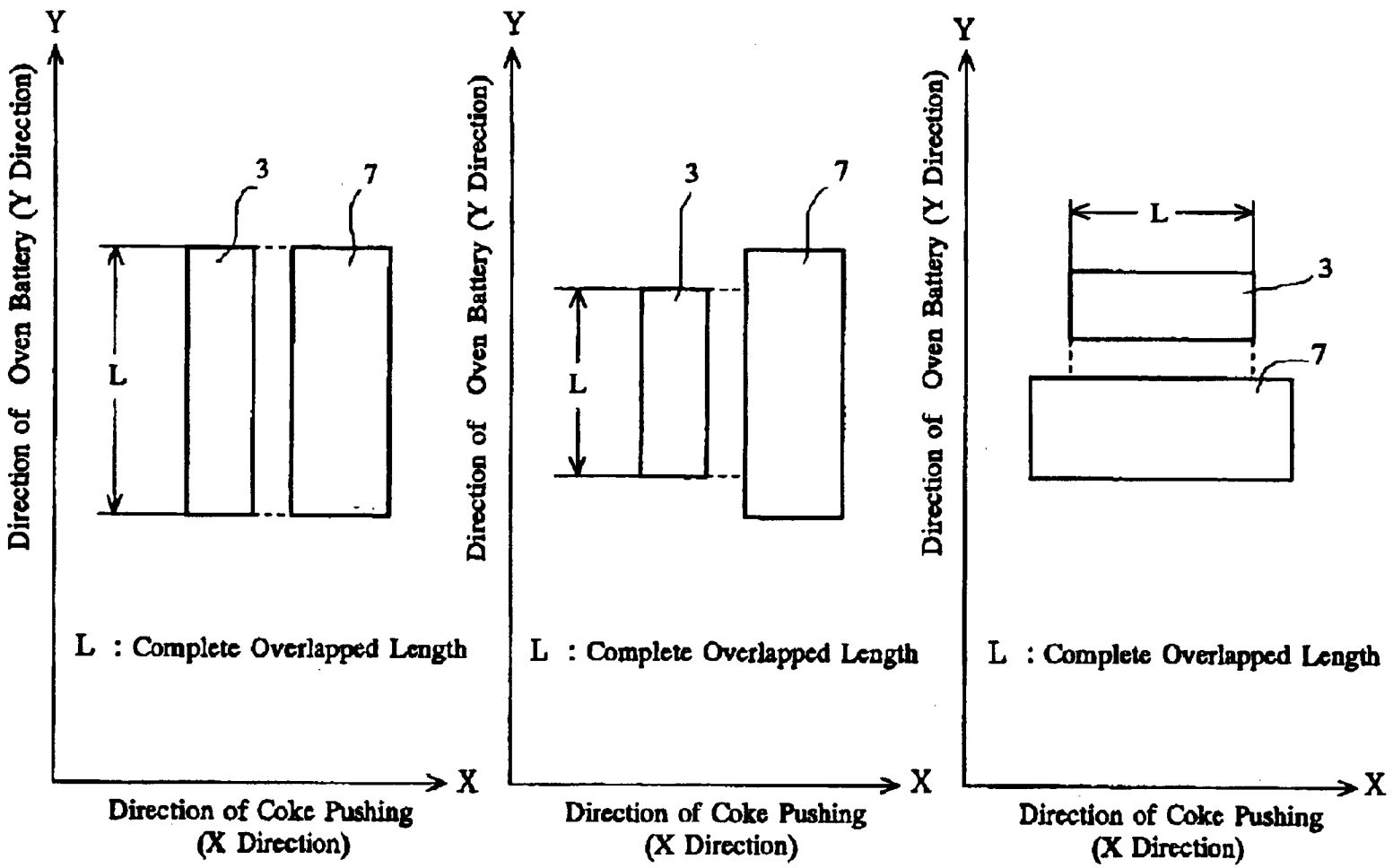
FIG. 8 is a diagram schematically showing the conventional arrangement of a lean-gas port and an air port.
Figure 9:
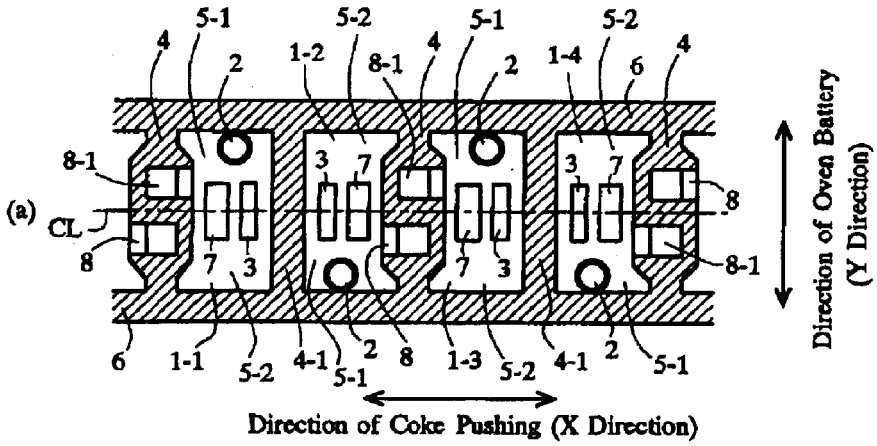
FIG. 9 is a diagram shoving the conventional arrangement of a lean-gas port and an air port.
Figure 9:
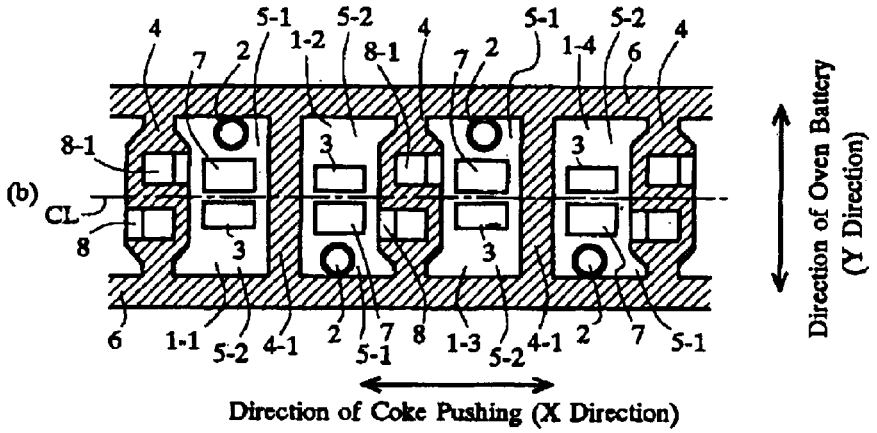

FIG. 8 is a diagram schematically showing the conventional arrangement of the lean-gas port 7 and the air port 3 shown in FIG. 9.

FIG. 8(*a*) shows an example in which the lean-gas port 7 and the air port 3 do not overlap when viewed in the direction of oven battery (Y direction), but they completely overlap when viewed in the direction of coke pushing (X direction), and thus corresponds to the arrangement shown in FIG. 9(*a*).

FIG. 8(*b*) shows an example in which the air port 3 is shorter than the lean-gas port 7, and thus the air port 3 is completely included in the lean-gas port 7 when viewed in the direction of coke pushing.

FIG. 8(*c*) shows an example in which the lean-gas port 7 and the air port 3 are arranged one behind the other when viewed in the direction of oven battery, and thus corresponds to the example shown in FIG. 9(*b*). In this case, the ports 7 and 3 completely overlap in the direction of oven battery (Y direction), but they do not overlap and thus are completely separated from each other when viewed in the direction of coke pushing (X direction).

Here, the length "L" in FIG. 8 is referred to as the complete overlapped length. In the examples shown in FIGS. 8(*b*) and (*c*), the air port 3 is shorter than the lean-gas port 7, and thus the length of the air port itself equals the complete overlapped length L. Conversely, when the air port is longer than the lean-gas port, the length of the lean-gas port equals the complete overlapped length L.

As described earlier, in order to suppress the excessive mixture of the gas and air at the bottom of combustion chamber in such a narrow space as the combustion chamber of a coke oven, it is important to suppress their excessive mixture immediately after they are purged from the bottom of combustion chamber. To achieve this, it is necessary to keep the lean-gas port apart from the air port as much as possible. A specific structure for achieving this is-such that the lean-gas port 7 and the air port 3 are arranged diagonally at the bottom of combustion chamber as shown in FIG. 7.

With such a structure, the lean gas and the air purged from the bottom of combustion chamber rise within the combustion chamber independently of each other when viewed in terms of a vertical cross section of the combustion chamber. Thus, although the lean gas and the air are partially mixed to be burnt partially at the bottom of combustion chamber, the majority of the lean gas and the air rise without being mixed, and the rising lean gas is gradually mixed with the rising air so that the gas burns gradually all along the height of the combustion chamber. Therefore, high-temperature combustion does not occur locally, and thus a uniform temperature is achieved in the direction of oven height and the aunt of $NO_x$ generated is reduced.

From the viewpoint of keeping the lean-gas port away from the air port as much as possible, the condition shown in FIG. 7(*a*) in which they are completely separated is desirable. However, when the lean-gas port is apart from the air port excessively, combustion in the lowermost region of the combustion chamber is suppressed too much so it causes temperature drops in the lowermost region of the combustion chamber. Therefore, it is desirable that the intervals $X_1$, $Y_1$, $X_2$ and $Y_3$ shown in FIG. 7 be kept at about 40% of the complete overlapped length L defined previously. Note that the size of the lean-gas port and that of the air port may be appropriately selected so that the supplied gas and air can diffuse almost uniformly within the combustion chamber. Further, the shape of the lean-gas port and that of the air port may not be limited to rectangles but may be oval and the like.

As shown in FIGS. 7(*b*) and (*c*), the lean-gas port 7 and the air port 3 may partly overlap when viewed in the direction of coke pushing (X direction) or in the direction of oven battery (Y direction). It is desirable that the overlapped length ($Y_3$ or $X_1$) at that time be 80% or less of the complete overlapped length L. This is because, as shown in examples to be described later, when these overlapped lengths exceed 80% of L, the $NO_x$ content drastically increases.

Figure 16:
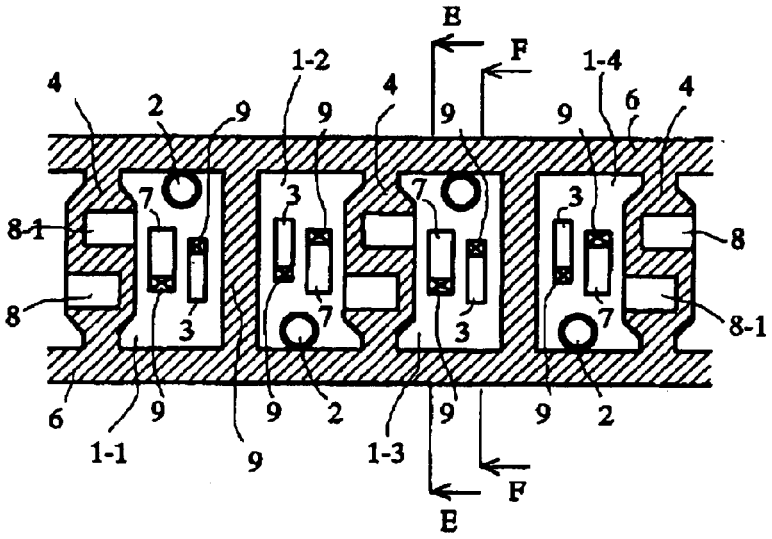
FIG. 16 is a diagram illustrating an example of a combustion chamber in which aperture adjusting members are mounted on a lean-gas port and an air port at its bottom.
Figure 16:
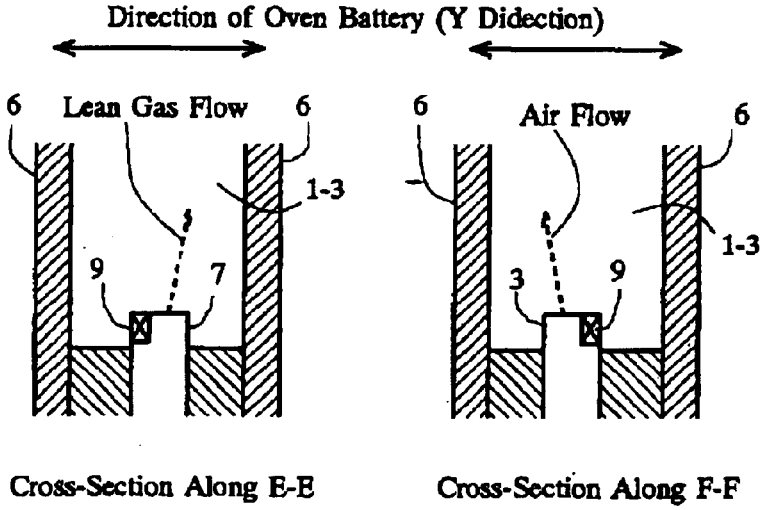

When the lean-gas port and the air port overlap by a large length when viewed in the direction of coke pushing or in the direction of oven battery, the lean gas is mixed with the air actively in the vicinity of the port exits (in the lower region of the combustion chamber), and thus localized high-temperature combustion is likely to occur. In such a case, as shown in FIG. 16, not only the member for adjusting their aperture is mounted on each port to materially decrease the overlap rate, but also the direction in which one or both of the lean gas and the air are purged is inclined properly from a direction in which contact between the lean gas and the air is suppressed to the opposite direction, whereby further uniform combustion and minimization of $NO_x$ can be achieved.

Figure 17:
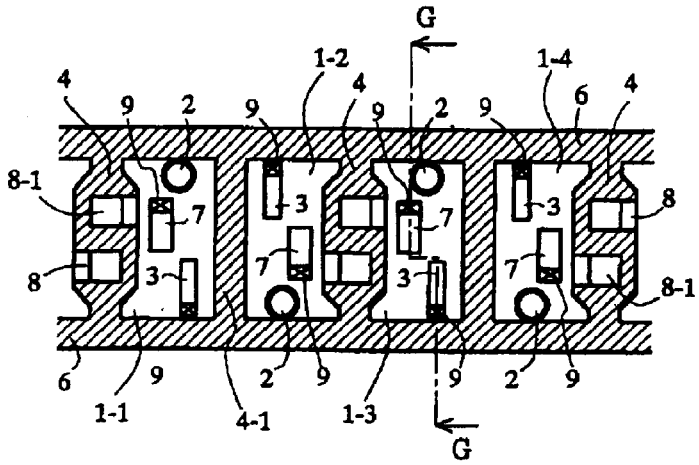
FIG. 17 is a diagram illustrating another example of a combustion chamber in which aperture adjusting members are mounted on a lean-gas port and an air port at its bottom.
Figure 17:
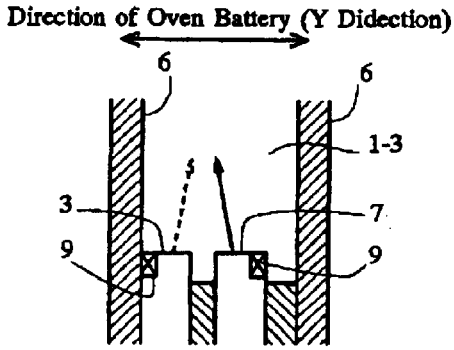
Figure 18:
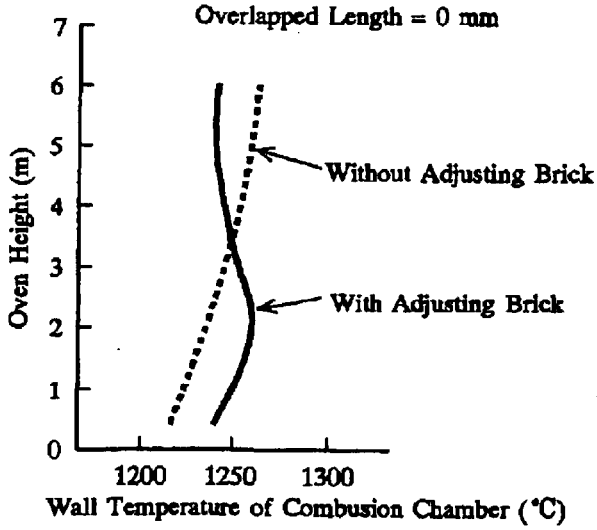
FIG. 18 is a diagram showing test results in an example.

On the contrary, when the lean-gas port and the air port do not overlap at all in the direction of coke pushing and in the direction of oven battery, or when they do overlap but the overlap rate is small, combustion in the lower region of the combustion chamber is retarded and thus temperature differences are likely to increase in the direction of oven height. In such a case, as shown in FIG. 17, one may attach the aperture adjusting member to one or both of the ports so that the directions of purging the lean gas and the air are so inclined in order to promote their contact. With this arrangement, combustion at the bottom of combustion chamber is promoted, and thus uniform heating can be achieved.

The above-described aperture adjusting members can be utilized when the present invention is applied to existing coke ovens as well. That is, the adjusting member made of a refractory or the like is attached to at least an end of either the lean-gas port or the air port to thereby close part of its opening, so that the dimensions and positional relationship specified by the present invention can be obtained for these ports. This member is useful to optimize the mixed condition of the lean gas and the air while changing the direction of flow of the lean gas and/or the air.

In the ovens capable of multistage combustion shown in FIGS. 4 and 6, the total amount of air may be supplied from the air port 3, but part of the air may also be supplied from the air ports 8 to thereby effect multistage combustion. In this case, it is desirable that the air supplied from the port 3 be in the range of 20–70% by volume of the total amount of air.

Figure 10:
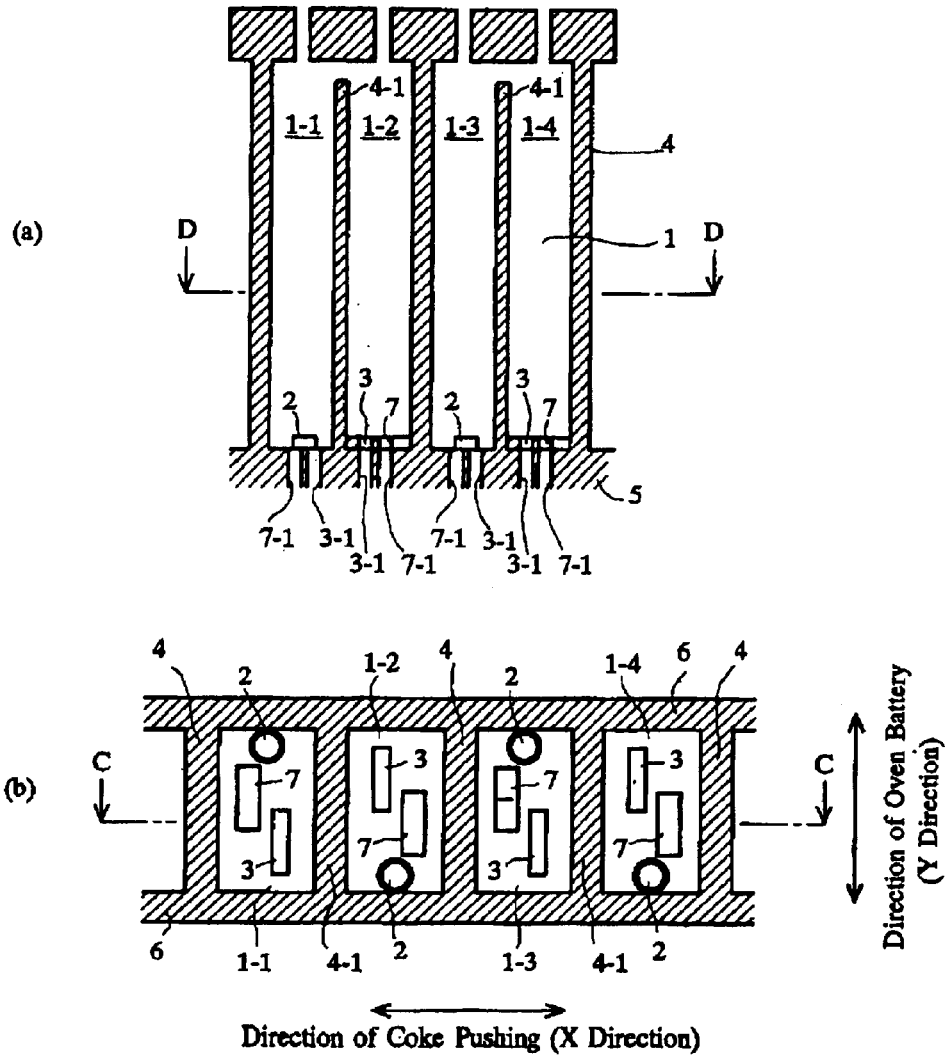
FIG. 10 is a diagram showing an exemplary structure of a combustion chamber of a compound combustion and singlestage combustion coke oven according to the present invention.

FIG. 10 is a diagram showing an exemplary combustion chamber of a compound combustion and singlestage combustion coke oven of the present invention. FIG. 10(*a*) is a vertical sectional view (a cross section taken along a line C—C of FIG. 10(*b*)), and FIG. 10(*b*) is a horizontal sectional view (a cross section taken along a line D—D of FIG. 10(*a*)). As shown in the drawings, the secondary air ports 8 and the secondary air duct 8-1 are eliminated from the multistage type shown in FIG. 4. In this example, the arrangement of the lean-gas port 7 and the air port 3 at the bottom of combustion chamber 5, there is no overlap between the ports 7 and 3 when they are viewed in the direction of oven battery, but there is a partial overlap when viewed in the direction of coke pushing.

The above-described lean-gas port 7 and air port 3 may be arranged so that they are completely separated when viewed both in the direction of coke pushing and in the direction of oven battery of the combustion chamber as shown in FIG. 7(*a*). Further, as shown in FIGS. 7(*b*) and (*c*), the ports 7 and 3 may be arranged so as to partially overlap when viewed in the direction of coke pushing (X direction) or in the direction of oven battery (Y direction). At this time, it is desirable that the length of the overlapped openings be 80% or less of the complete overlapped length (L shown in FIG. 8). The above-described overlap rate of 80% or less may be achieved by attaching the aperture adjusting member (e.g., a refractory) to at least one of the lean-gas ports 7 and the air ports 3.

2. Method of the Present Invention

Using the coke oven of the present invention so far described, the method of the present invention will be performed as described hereinafter.

In the case of a rich gas combustion or a lean gas combustion, the direction of purging the lean gas and/or the air is changed by mounting the aperture adjusting member on the opening of at least one of the lean-gas ports and the air ports of the combustion chamber, thereby adjusting the mixing point of the rich or lean gas and air. With this arrangement, uniform combustion can be achieved within the combustion chamber, and thus $NO_x$ in the waste gas can be reduced. In this method also, it is desirable that in the case of lean gas combustion, the length of the previously described overlapped openings be 80% or less of the complete overlapped length, and that in the case of rich gas combustion, the centers of the air port, or the midpoint connecting the centers of the two air ports, or the midpoint connecting the centers of the lean-gas port and the air port be on the side opposite to the rich-gas port across the center line extending in the direction of coke pushing of the combustion chamber in parallel to the oven wall.

In the operation of a multistage combustion coke oven in which part of air is supplied from the bottom, and the rest thereof from at least one air port provided in the flue partition wall, it is desirable that the amount of combustion air supplied from the bottom be 20–70% by volume of the total in the case of lean gas combustion and be 50% by volume or more in the case of rich gas combustion.

EXAMPLES

Examples in which how the lean-gas port and the air port are arranged at the bottom of combustion chamber and in which the arrangement of two air ports in varied will be described individually, in cases of the rich gas combustion and the lean gas combustion. Example 1 deals with rich gas combustion and Examples 2 to 6 deal with lean gas combustion.

Example 1

Combustion tests were conducted using a coke oven having combustion chambers such as shown in FIGS. 3 and 4. The inner shape of each combustion chamber is as follows: the bottom length in the direction of coke pushing is 0.35 ml the bottom length in the direction of oven battery is 0.91 m; and the height is 6.6 m. The combustion chamber has two secondary air ports in the direction of oven height of its flue partition wall. The diameter of the rich-gas port is 77 m. Note that the secondary air ports provided in the flue partition wall were closed when sinlglestage combustion was effected. At the bottom of combustion chamber, the rich-gas port was arranged near the oven wall bordering the carbonization chamber, and the lean-gas port and the air port were arranged with their positions varied such as shown in Table 1.

TABLE 1

| | | | | Amount of air supplied (% by volume) | | | Test results | |
|---|---|---|---|---|---|---|---|---|
| Classification | Test No. | Port arrangement | Port adjustment | Bottom of combustion chamber | Flue partition wall height (second stage, third stage) | Waste gas circulation | Wall temperature difference (° C.) | $NO_x$ content (ppm) |
| Examples of the present invention | 1 | Side by side | No | 100 | None | No | 80 | 120 |
| | 2 | Side by side | No | 100 | None | Yes | 60 | 100 |
| | 3 | Staggered | No | 100 | None | No | 83 | 125 |
| | 4 | Staggered | Yes | 100 | None | No | 65 | 100 |
| | 5 | Staggered | Yes | 100 | None | Yes | 54 | 91 |

TABLE 1-continued

| Classification | Test No. | Port arrangement | Port adjustment | Amount of air supplied (% by volume): Bottom of combustion chamber | Amount of air supplied (% by volume): Flue partition wall height (second stage, third stage) | Waste gas circulation | Test results: Wall temperature difference (° C.) | Test results: $NO_x$ content (ppm) |
|---|---|---|---|---|---|---|---|---|
| | 6 | Side by side | No | 70 | (10%, 20%) | No | 65 | 100 |
| | 7 | Side by side | No | 70 | (10%, 20%) | Yes | 40 | 72 |
| | 8 | Staggered | No | 70 | (10%, 20%) | No | 65 | 95 |
| | 9 | Staggered | No | 70 | (10%, 20%) | Yes | 52 | 81 |
| | 10 | Staggered | Yes | 70 | (10%, 20%) | No | 58 | 86 |
| | 11 | Staggered | Yes | 70 | (10%, 20%) | Yes | 45 | 75 |
| | 12 | Staggered | Yes | 50 | (17%, 33%) | Yes | 50 | 79 |
| | 13 | Staggered | Yes | 60 | (13%, 27%) | Yes | 48 | 75 |
| Comparative example | 14 | Side by side | No | 100 | None | No | 150 | 225 |
| | 15 | Side by side | No | 100 | None | Yes | 135 | 190 |
| | 16 | Side by side | Yes | 100 | None | Yes | 130 | 186 |
| | 17 | Staggered | No | 40 | (20%, 40%) | Yes | 95 | 162 |
| | 18 | Staggered | Yes | 40 | (20%, 40%) | Yes | 81 | 137 |
| | 19 | Staggared | No | 100 | None | Yes | 142 | 205 |

A rich gas whose calorific value is 19320 kJ/$Nm^3$ (4600 kcal/$Nm^3$) was used, and was supplied to each combustion chamber at a flow rate of 28 $Mm^3$/h.

For singlestage combustion, the total amount of air (100% by volume) was supplied from the bottom of combustion chamber, and for multistage combustion 40–70% by volume of air was supplied from the bottom, wherein about ⅓ air was supplied from the second-stage air port, and the rest was supplied from the third-stage air port.

Further, in the case of varying the amount of air supplied from the bottom of combustion chamber for multistage combustion, the ratio of the air supplied from the second-stage air port to the air supplied from the third-stage air port was 1:2. The air was supplied at a flow rate of 160 $Nm^3$/h per combustion chamber in each case.

The combustion tests were evaluated by measuring the temperature of the oven wall (see reference numeral 6 in FIG. 3) of the combustion chamber and the $NO_x$ content in the waste gas. These results are also shown in Table 1.

Figure 11:
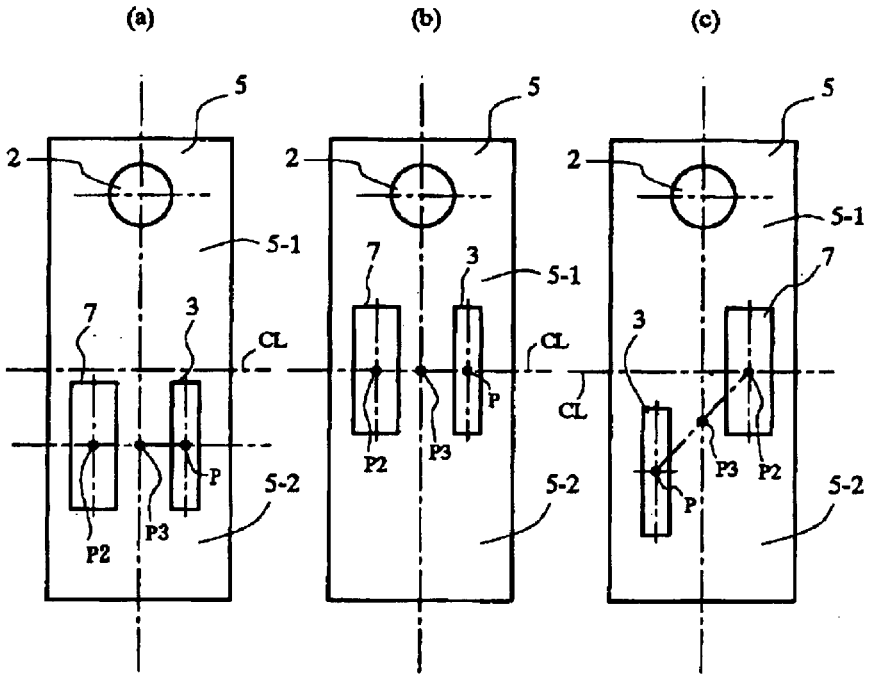
FIG. 11 is a plan view showing the arrangement of a lean-gas port and an air port at the bottom of combustion chamber in a compound combustion oven.

Test Nos. 1, 2, 6 and 7 are examples in which the lean-gas port and the air port were arranged side by side as shown in FIG. 11(*a*) and the combustion chamber of the present invention was used, the chamber being such that the midpoint P3, between the centers P2 and P of these ports, was located in the second zone 5-2 distant from the rich-gas port in the first zone 5-1 of the combustion chamber bottom. Further, test Nos. 3 to 5 and 8 to 13 are examples using the combustion chamber of the present invention, in which the lean-gas port and the air port were staggered and the midpoint P3 between the centers P2 and P of these ports was located in the second zone 5-2 distant from the rich-gas port in the first zone 5-1 of the combustion chamber bottom.

Test Nos. 1 to 5 are examples of singlestage combustion in which air was supplied from the bottom of combustion chamber, and test Nos. 6 to 13 are examples of multistage combustion in which air was supplied from the bottom of combustion chamber and the flue partition wall.

As is apparent from Table 1, the examples of the invention in test Nos. 1 to 13 were satisfactory, exhibits differences of wall temperature in the direction of oven height ranging from 40 to 83° C. and amounts of $NO_x$ generated ranging from 72 to 125 ppm.

When comparing test Nos. 3 with 4, 8 with 10, and 9 with 11, test Nos. 4, 10 and 11, in each of which the aperture adjusting member was mounted on the opening located on the side of the rich-gas port by crossing the center line CL extending in the direction of coke pushing of the combustion chamber, exhibited small differences of wall temperature in the direction of oven height and small amounts of $NO_x$ generated. Further, when comparing test Nos. 1 with 2, 4 with 5, 6 with 7, 8 with 9, and 10 with 11, test Nos. 2, 5, 7, 9 and 11, in each of which the waste gas was circulated, exhibited small differences of wall temperature in the direction of oven height and particularly small amounts of $NO_x$ generated.

Further, test Nos. 12 and 13 are examples in which the amount of air supplied from the bottom of combustion chamber was varied. When the amount of air supplied from the bottom was 50% by volume or more, differences of wall temperature in the direction of oven height were small and amounts of $NO_x$ generated were small.

In contrast, test No. 14, which is a comparative example using the conventional combustion chamber, in which the center P2 of the lean-gas port and the center P of the air port were arranged, side by side, so as to coincide with the center line CL extending in the direction of coke pushing of the combustion chamber, as shown in FIG. 11(*b*), and thus exhibited a temperature difference in the direction of oven wall height as large as 150° C. and an amount of $NO_x$ generated as large as 225 ppm. Since test No. 15 is similar to test No. 14 except that the waste gas was circulated in the former, test No. 15 exhibited a temperature difference in the direction of the oven wall height as large as 135° C. and an amount of $NO_x$ generated as large as 190 ppm.

Figure 12:
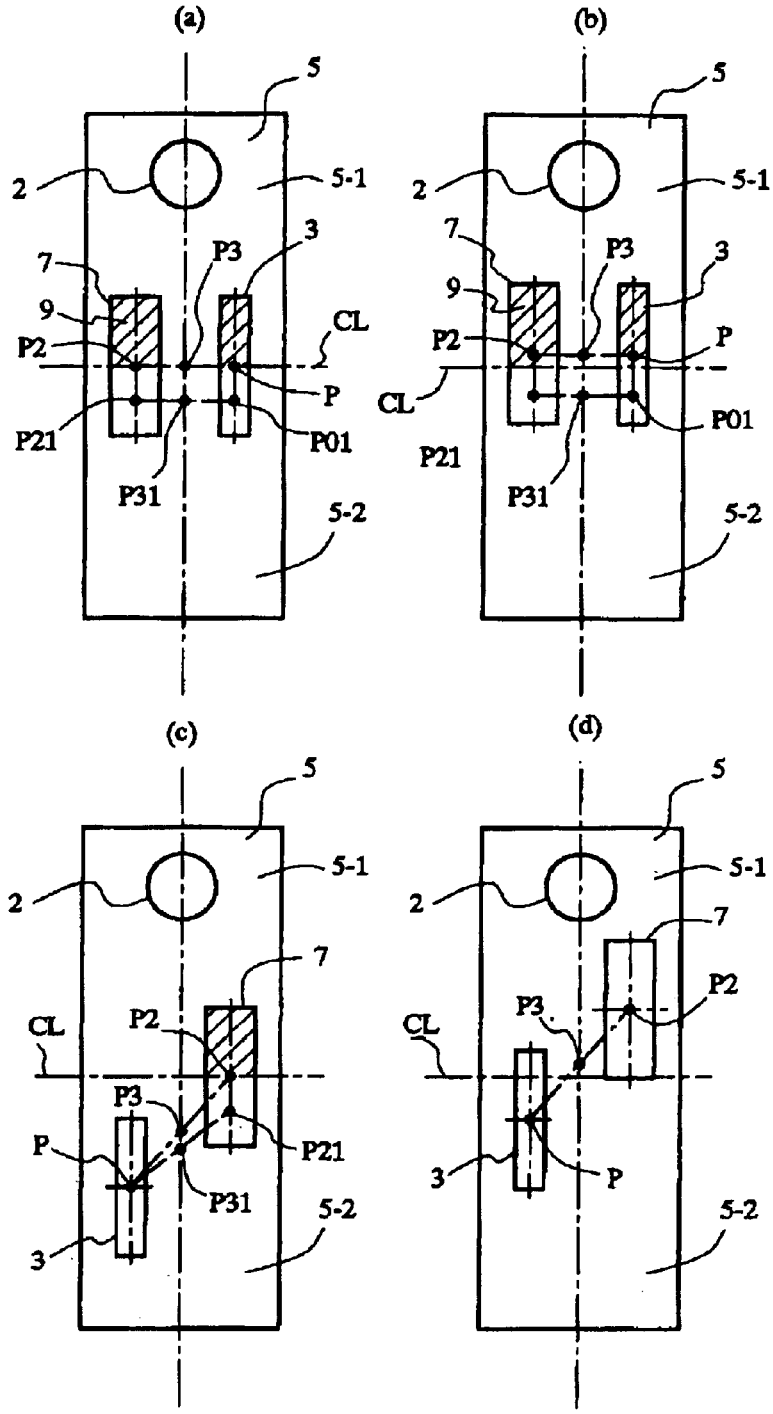
FIG. 12 is a plan view showing states in which aperture adjusting members are mounted on a lean-gas port and an air port at the bottom of combustion chamber.

In test No. 16, the lean-gas port and the air port were arranged side by side, and the midpoint P3 between their centers P2 and P was moved into the second zone 5-2 as shown by P31, with the aperture adjusting members mounted on their openings as shown in FIG. 12(*b*). This comparative example exhibited a temperature difference in the direction of the oven wall height as large as 130° C. and an amount of $NO_x$ generated as large as 186 ppm.

In test No. 17, the lean-gas port and the air port were staggered and the midpoint P3, between their centers P2 and P, was moved to a position opposite to the rich-gas port in the second zone 5-2, with the aperture adjusting member mounted on the opening as shown in FIG. 12(*c*). Since the amount of air supplied from the bottom of combustion chamber was 40% by volume of the total, it exhibited a temperature difference in the direction of the oven wall height as large as 95° C. and an amount of $NO_x$ generated as large as 162 ppm. Further, test No. 18 is similar to test No. 17 except that the waste gas was circulated in the forger, and thus exhibited a temperature difference in the direction of the oven wall height as large as 81° C. and an amount of $NO_x$ generated as large as 137 ppm.

Test No. 19, in which the lean-gas port and the air port were staggered and the midpoint P3, between their centers P2 and P, was on the side of the rich-gas port, i.e., in the first zone 5-1, as shown in FIG. 12(*d*). Therefore it exhibited a temperature difference in the direction of the oven wall height as large as 142° C. and an amount of $NO_x$ generated as large as 205 ppm.

Example 2

In the multistage combustion chamber shown in FIG. 4, only a lean gas whose calorific value is 4620 kJ/$Nm^3$ (1100 kcal/$Nm^3$) was used as a fuel gas, and air was supplied so that the oxygen content in the waste gas after combustion was 1.5%. The air was supplied in such a manner that 50% of the total amount was supplied from the air port 3, 20% of the total from the lower air port 8 formed in the flue partition wall, and the rest from the upper air port 8, whereby multistage combustion was effected. Note that the basic structure of the combustion chamber is such that the height is 6.6 m and the minimum inner dimensions of the bottom surface is 0.91 m×0.3 m. This basic structure is common to the following examples, except that the minimum inner dimensions of the bottom surface of the combustion chamber for singlestage combustion is 0.91 m×0.35 m.

Figure 13:
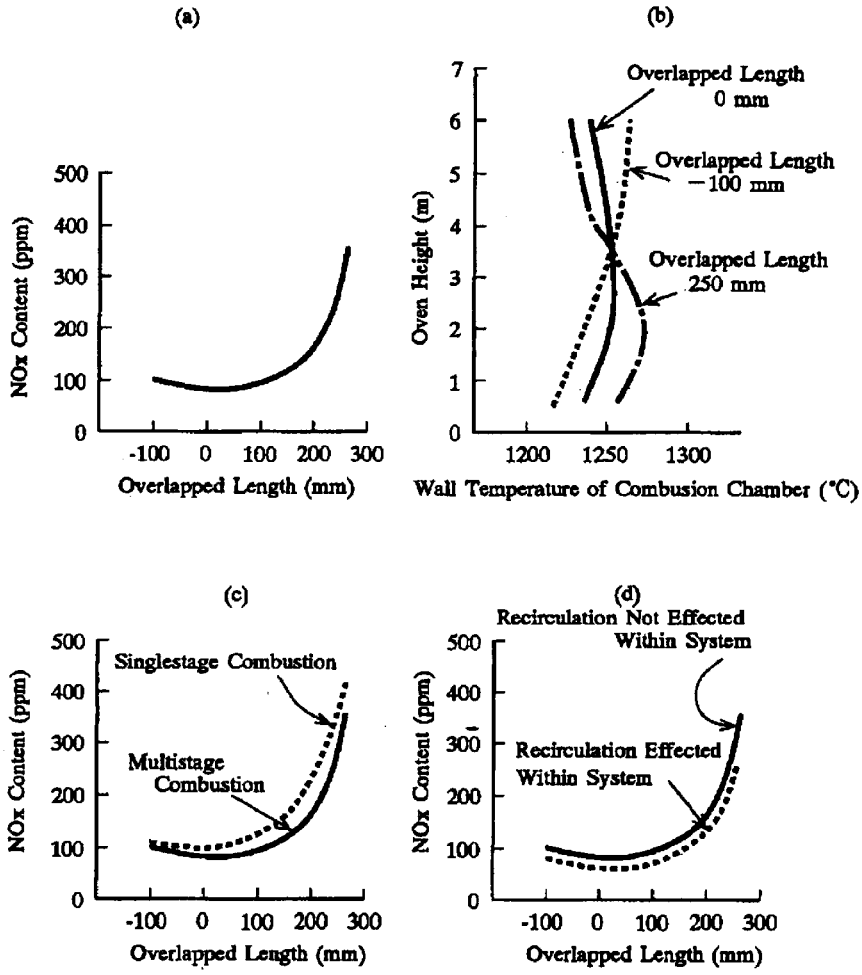
FIG. 13 is a diagram showing test results in an example.

FIG. 13 shows the results of tests conducted in the combustion chamber structure of FIG. 4(*b*), i.e., in the coke oven in which the lean-gas port and the air port were arranged as shown in FIG. 7(*b*). The size of the lean-gas port and that of the air port are as described below. The separated length $X_2$ in the direction of coke pushing was fixed at 40 mm, and the overlapped length ($Y_2$) when viewed in the direction of coke pushing was varied.

Lean-gas port . . .
- Length in the direction of oven battery ($L_1$): 250 mm
- Length in the direction of coke pushing (Width, $W_1$): 85 m Air port . . .
- Length in the direction of oven battery ($L_2$): 250 mm
- Length in the direction of coke pushing (Width, $W_2$): 50 mm FIG. 13(*a*) is a graph showing the relationship between the overlapped length ($Y_2$ in FIG. 7) when viewed in the direction of coke pushing and the $NO_x$ content in the waste gas. In this drawing, any negative overlapped length means there is no overlap between the ports, and its absolute value indicates the separated length. It is apparent from this drawing that the $NO_x$ content is low when the overlapped lengths range from −100 to 200 mm and drastically increases when the overlapped length exceeds 200 mm. The above-described value of 200 mm accounts for 80% of the length in the direction of oven battery ($L_1$: 250 mm) of the lean-gas port (and the air port). Therefore, the overlapped length ($Y_2$) is desirable to be 80% or less of the length $L_1$ in the direction of oven battery. Since the complete overlapped length L equals $L_1$ in this example, the above-described rate of 80% equals 80% of the complete overlapped length L.

FIG. 13(*b*) shows the wall temperatures of combustion chamber in the direction of oven height when the previously described overlapped length $Y_2$ was 250 mm (the overlap rate was 100%), 0 mm (no overlap nor separation), and −100 mm (the separated length was 100 mm and the separation rate 40%). It is recognized from this drawing that the wall temperature of combustion chamber in the lower region is too high when the overlapped length is 250 mm, i.e., at an overlap rate of 100% and that this is the cause for the drastic increase in $NO_x$ content shown in FIG. 13(*a*). On the other hand, when the overlapped length is −100 mm, i.e., when the separation rate is 40%, the wall temperature of combustion chamber is low in the lower region and high in the upper region, exhibiting a comparatively nonuniform temperature distribution in the direction of the oven height.

The nonuniform temperature distribution in the direction of combustion chamber height can be eliminated to some extent by, e.g., by adjusting the percentage of supplying air from the bottom of combustion chamber and providing the lean gas and/or air ports with aperture adjusting means, but their effects should have limitations. Therefore, it is desirable that the overlap rate be limited to 80% or less and the separation rate 40% or less.

FIG. 13(*c*) shows the test results (indicated by the dotted line) obtained when singlestage combustion was effected by supplying the total amount of air from the bottom of a combustion chamber of the same structure, the results being added to FIG. 13(*a*). While the $NO_x$ content in singlestage combustion is somewhat higher than in multistage combustion, the effect derived from the overlapped length exhibits a similar tendency. Thus, the $NO_x$ content is greatly decreased when the overlapped length was 150 mm or less (the overlap rate was 60%).

FIG. 13(*d*) shows data obtained when the waste gas was circulated within the system in multistage combustion effected in a combustion chamber of the same structure, the data being added to FIG. 13(*a*). When the waste gas was circulated within the system, a similar tendency was exhibited to the case where no circulation was effected, but the $NO_x$ content decreased. That is, the advantageous effect of the present invention is obtained independently of whether circulation is performed or not performed.

Figure 14:
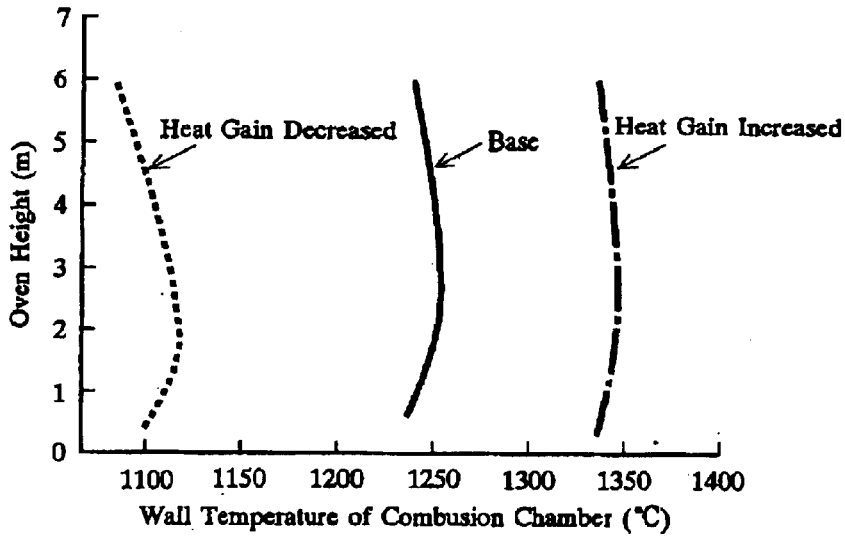
FIG. 14 is a diagram showing test results in an example.

FIG. 14 shows the results of measurements made as to the wall temperature of combustion chamber when the amount of lean gas supplied (heat gain) was varied in the multistage combustion which was effected in a combustion chamber of the same structure. At this time, the overlapped length $Y_1$, between the lean-gas port and the air port, was 0 mm. The base shown by the solid line in FIG. 14 corresponds to the case where "the overlapped length was 0 mm" in FIG. 13(*b*). As shown in FIG. 14, the temperature pattern does not change with changing input gains, and thus, even if the operation conditions of the coke oven in terms of input gain is changed greatly, there is no need to adjust the fuel and the dimensions of the air ports, and hence the advantageous effect of the present invention can be maintained.

Example 3

Figure 15:
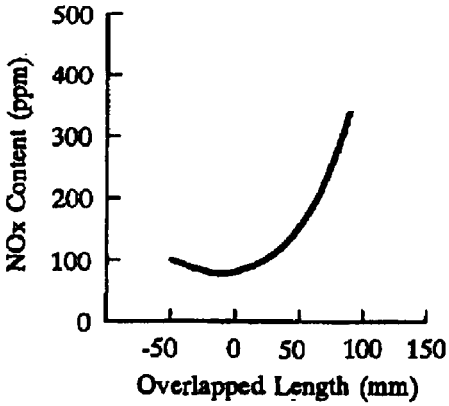
FIG. 15 is a diagram showing test results in an example.

FIG. 15 shows the results of tests conducted based on the arrangement of FIG. 7(*c*) in lean gas combustion, and is a graph similar to FIG. 13(*a*). The size of the lean-gas port and that of the air port are as described below. The separated length $Y_3$ in the direction of oven battery was fixed at 40 mm, and the overlapped length ($X_3$) when viewed in the direction of oven battery was varied.

Lean-gas port . . .
- Length in the direction of oven battery ($L_1$): 250 mm
- Length in the direction of coke pushing (Width, $W_1$): 100 mm Air port . . .
- Length in the direction of oven battery ($L_2$): 150 mm
- Length in the direction of coke pushing (Width, $W_2$): 100 mm It is apparent from FIG. 15 that the $NO_x$ content was reduced to 150 ppm or less when the overlapped lengths ranged from −50 mm (the separation rate was 50%) to 50 mm (the overlap rate was 50%).

Example 4

Aperture adjusting tests were conducted in the sane conditions as in Example 2 described earlier. That is, in the arrangement of FIG. 4(*b*), i.e., in FIG. 7(*b*), the overlapped length $Y_2$, when viewed in the direction of coke pushing, was set to 200 mm (the overlap rate was 80%), and the openings of the lean-gas port and the air port were adjusted by attaching thereto the aperture adjusting members (adjusting bricks).

FIG. 16 shows how the adjusting bricks 9 were arranged. As shown in FIG. 16(*a*), the 50 mm aperture adjusting members 9 were attached to the lean-gas port 7 and the air port 3 at one end thereof. At that time, the aperture adjusting members 9 were arranged at the ends at which the lean-gas port and the air port overlap, as shown in FIG. 16(*b*). With this arrangement, the material overlapped length was reduced to 100 mm (the overlap rate was 40%).

When no adjusting bricks were attached, the overlapped length $Y_2$ of both ports was 200 mm (the overlap rate was 80%), and the $NO_x$ content at that time was about 160 ppm as shown in FIG. 13(*a*). By contrast, when the adjusting bricks 9 were attached, not only the substantial overlap rate was decreased as described above, but also the flow directions of the lean gas and the combustion air changed in such directions as to be separated from each other, as shown in FIG. 16(*b*). As a result of these operations, the $NO_x$ content was reduced to 95 ppm. Thus, the advantageous effect of the present invention can be improved with such simple operations performed on the ports.

Example 5

FIG. 17 shows how the adjusting bricks were attached to the lean-gas port and the air port arranged, as shown in FIG. 6(*a*). The size of the lean-gas port 7 and that of the air port 3 were the same as in Example 2. Neither port overlapped when viewed in the direction of coke pushing, and they were separated by 100 mm (in other words, the overlapped length was −100 mm and the separation rate was 40%) when viewed in the direction of oven battery. In this case, since the overlapped length is negative, the temperature is lower in the lower region of the combustion chamber than in the upper region as shown in FIG. 13(*b*).

Figure 19:
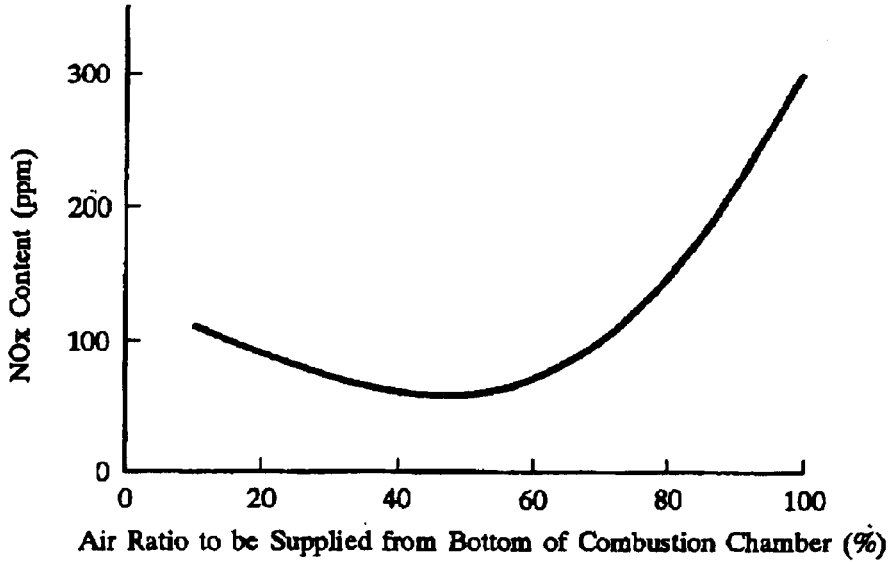
FIG. 19 is a diagram showing test results in an example.
Figure 19:
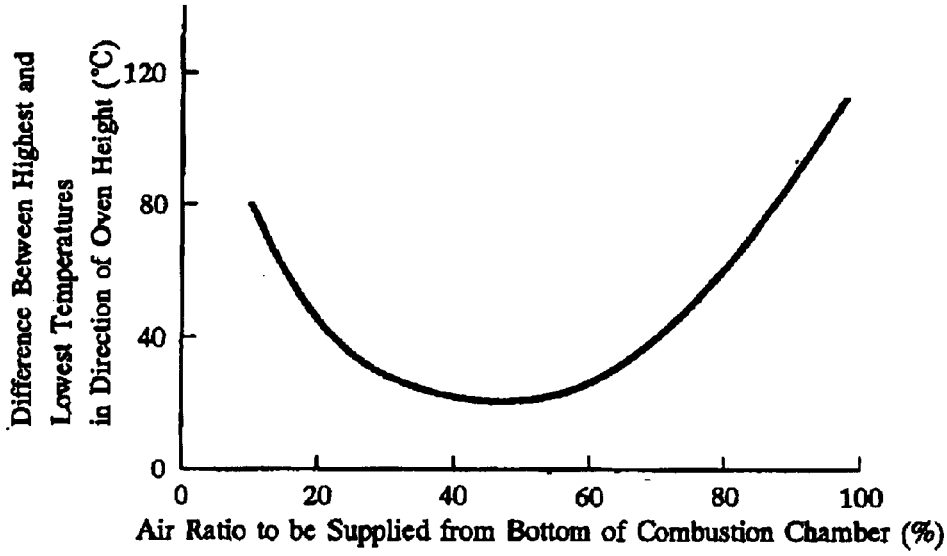

In the above-described arrangement, when 50 mm long aperture adjusting members 9 were attached to the lean-gas port and the air port, respectively, as shown in FIGS. 17(*a*) and (*b*), the flow directions of the lean gas and the air changed as shown in FIG. 17(*b*). Although the $NO_x$ content in this case did not change before and after the adjusting bricks were attached, a uniform temperature distribution in the direction of oven height was achieved with the temperature at the oven bottom rising and the temperature in the upper region of the oven dropping, as shown in FIG. 19. This is because the flow of the lean gas nears that of the combustion air due to the presence of the adjusting bricks, and thus an effect equivalent to a reduction in separation rate was obtained.

Example 6

Tests were carried out by changing the amount of air to be supplied from the air port 3, at the bottom of combustion chamber, within the range of 10–90% of the total while providing no overlapped length between both ports when viewed in the direction of oven battery. The tests were conducted under the same conditions as in Example 2 using an apparatus having a structure as shown in FIG. 4(*b*). The rest of the air was supplied from the two air ports 8 arranged in the flue partition wall at the ratio of 1:1.5.

FIG. 19(*a*) is a graph showing the relationship between the percentage of the amount of air to be supplied from the bottom of combustion chamber (air port 3) and the $NO_x$ content in the waste gas, and FIG. 19(*b*) is a similar graph showing differences between the highest and lowest temperatures in the direction of combustion chamber wall height. As shown in these drawings, when air ratio to be supplied from the bottom of combustion chamber exceeds 70%, not only the $NO_x$ content drastically increases, but the difference in the combustion wall temperature also increases. This is because the combustion temperature at the bottom of combustion chamber increases locally. On the other hand, when the air ratio was less than 20%, the temperature at the bottom of combustion chamber drops, and thus the difference in the combustion wall temperature increases. As is apparent from these results, it is desirable that the air to be supplied from the air port 3, at the bottom of combustion chamber, range from 20 to 70% of the total air amount.

Since the arrangement of the lean-gas port and the air port is optimized at the bottom of a combustion chamber of a coke oven according to the present invention, uniform combustion can be achieved in the direction of oven height both during the rich gas combustion and during the lean gas combustion. As a result, localized high-temperature combustion is reduced, and thus the amount of $NO_x$ generated is reduced. Further, since the heating temperature inside each carbonization chamber is also made uniform, high-quality coke can be obtained. The present invention may be applied not only to newly installed coke ovens, but also to existing ovens through a simple method of attaching an aperture adjusting member to the lean-gas port and/or the air port.

What is claimed is:

1. A coke oven including an array of combustion chambers separated from carbonization chambers by oven walls, each combustion chamber comprising a rich-gas port, and a pair of a lean-gas port and an air port, all of the ports are located on the bottom of the combustion chamber;

characterized in that (1) the combustion chamber is defined into a first zone and a second zone by a center line extending in the direction of coke pushing, (2) said rich-gas port is located near the oven wall of the first zone, (3) the midpoint connecting the centers of said lean-gas port and said air port is in the second zone, and (4) said lean-gas port and said air port do not completely overlap in any of the directions when viewed both in a direction of coke pushing and in a direction of oven battery of said combustion chamber.

2. A coke oven according to claim 1, wherein when viewed both in the direction of coke pushing and in the direction of oven battery of said combustion chamber, the overlapped length of said air port and said lean-gas port in each direction is 80% or less of the complete overlapped length.

3. A coke oven according to claim 1, further characterized in that at least one of said air port and said lean-gas port is provided with an aperture adjusting member for adjusting the flow of lean gas and/or air.

4. A coke oven according to claim 2, further characterized in that at least one of said air port and said lean-gas port is provided with an aperture adjusting member for adjusting the flow of lean gas and/or air.

5. A method of operating a coke oven according to claim 1, characterized by effecting singlestage combustion by supplying a total amount of lean gas and a total amount of air from said lean-gas port and said air port provided in the bottom of said combustion chamber, respectively.

6. A method of operating a coke oven according to claim 2, characterized by effecting singlestage combustion by supplying a total amount of lean gas and a total amount of air from said lean-gas port and said air port provided in the bottom of said combustion chamber, respectively.

7. A method of operating a coke oven according to claim 3, characterized by effecting singlestage combustion by supplying a total amount of lean gas and a total amount of air from said lean-gas port and said air port provided in the bottom of said combustion chamber, respectively.

8. A method of operating a coke oven according to claim 1, characterized by effecting multistage combustion by supplying a total amount of lean gas from said lean-gas port provided in the bottom of said combustion chamber, 20–70% by volume of the air from said air port provided in the bottom of said combustion chamber, and the rest of the air from port(s) provided in a flue partition wall of said combustion chamber.

9. A method of operating a coke oven according to claim 2, characterized by effecting multistage combustion by supplying a total amount of lean gas from said lean-gas port provided in the bottom of said combustion chamber, 20–70% by volume of the air from said air port provided in the bottom of said combustion chamber, and the rest of the air from port(s) provided in a flue partition wall of said combustion chamber.

10. A method of operating a coke oven according to claim 3, characterized by effecting multistage combustion by supplying a total amount of lean gas from said lean-gas port provided in the bottom of said combustion chamber, 20–70% by volume of the air from said air port provided in the bottom of said combustion chamber, and the rest of the air from port(s) provided in a flue partition wall of said combustion chamber.

11. A method of operating a coke oven according to claim 1, characterized by effecting multistage combustion by supplying part of lean gas from said lean-gas port provided in the bottom of said combustion chamber, the rest of the lean gas from said port(s) provided in said flue partition wall of said combustion chamber, and the total amount of the combustion air from said air port provided in the bottom of said combustion chamber.

12. A method of operating a coke oven according to claim 2, characterized by effecting multistage combustion by supplying part of lean gas from said lean-gas port provided in the bottom of said combustion chamber, the rest of the lean gas from said port(s) provided in said flue partition wall of said combustion chamber, and the total amount of the combustion air from said air port provided in the bottom of said combustion chamber.

13. A method of operating a coke oven according to claim 3, characterized by effecting multistage combustion by supplying part of lean gas from said lean-gas port provided in the bottom of said combustion chamber, the rest of the lean gas from said port(s) provided in said flue partition wall of said combustion chamber, and the total amount of the combustion air from said air port provided in the bottom of said combustion chamber.

14. A method of operating a coke oven according to claim 1, characterized by effecting multistage combustion by supplying part of the lean gas from said lean-gas port provided in the bottom of said combustion chamber, the rest of the lean gas from said port(s) provided in said flue partition wall of said combustion chamber, and 20–70% by volume of the combustion air from said air port provided in the bottom of said combustion chamber, and the rest of the combustion air from said port(s) provided in said flue partition wall of said combustion chamber.

15. A method of operating a coke oven according to claim 2, characterized by effecting multistage combustion by supplying part of the lean gas from said lean-gas port provided in the bottom of said combustion chamber, the rest of the lean gas from said port(s) provided in said flue partition wall of said combustion chamber, and 20–70% by volume of the combustion air from said air port provided in the bottom of said combustion chamber, and the rest of the combustion air from said port(s) provided in said flue partition wall of said combustion chamber.

16. A method of operating a coke oven according to claim 3, characterized by effecting multistage combustion by supplying part of the lean gas from said lean-gas port provided in the bottom of said combustion chamber, the rest of the lean gas from said port(s) provided in said flue partition wall of said combustion chamber, and 20–70% by volume of the combustion air from said air port provided in the bottom of said combustion chamber, and the rest of the combustion air from said port(s) provided in said flue partition wall of said combustion chamber.

17. A method of operating a coke oven according to claim 1, characterized by effecting singlestage combustion by supplying the total amount of a rich gas from said rich-gas port, and the total amount of air from said air port and/or said lean-gas port, said respective ports being provided in the bottom of said combustion chamber.

18. A method of operating a coke oven according to claim 2, characterized by effecting singlestage combustion by supplying the total amount of a rich gas from said rich-gas port, and the total amount of air from said air port and/or said lean-gas port, said respective ports being provided in the bottom of said combustion chamber.

19. A method of operating a coke oven according to claim 3, characterized by effecting singlestage combustion by supplying the total amount of a rich gas from said rich-gas port, and the total amount of air from said air port and/or said lean-gas port, said respective ports being provided in the bottom of said combustion chamber.

20. A method of operating a coke oven according to claim 1, characterized by effecting multistage combustion by supplying the total amount of a rich gas from said rich-gas port provided in the bottom of said combustion chamber, 50% by volume or more of the air from said air port and/or said lean-gas port provided in the bottom of said combustion chamber, and the rest of the air from said port(s) provided in said flue partition wall of said combustion chamber.

21. A method of operating a coke oven according to claim 2, characterized by effecting multistage combustion by supplying the total amount of a rich gas from said rich-gas port provided in the bottom of said combustion chamber, 50% by volume or more of the air from said air port and/or said lean-gas port provided in the bottom of said combustion chamber, and the rest of the air from said port(s) provided in said flue partition wall of said combustion chamber.

22. A method of operating a coke oven according to claim 3, characterized by effecting multistage combustion by supplying the total amount of a rich gas from said rich-gas port provided in the bottom of said combustion chamber, 50% by volume or more of the air from said air port and/or said lean-gas port provided in the bottom of said combustion chamber, and the rest of the air from said port(s) provided in said flue partition wall of said combustion chamber.

* * * * *